United States Patent [19]

Gotoh

[11] 4,146,061

[45] Mar. 27, 1979

[54] METHOD OF AND APPARATUS FOR MARKING WOVEN FABRIC WITH INDICIA DURING WEAVING OF THE WOVEN FABRIC

[75] Inventor: Miyuki Gotoh, Tokorozawa, Japan

[73] Assignee: Nissan Motor Company, Limited, Japan

[21] Appl. No.: 882,934

[22] Filed: Mar. 2, 1978

[30] Foreign Application Priority Data

Mar. 5, 1977 [JP] Japan ..... 52/23302

[51] Int. Cl.[2] ..... D03J 1/00

[52] U.S. Cl. ..... 139/1; 139/291 R; 139/1 B; 139/435; 112/131; 66/1 R

[58] Field of Search ..... 139/1 R, 1 B, 291 R, 139/336, 348, 435, 370.1, 370.2; 66/1, 166; 112/1, 131; 346/33

[56] References Cited

U.S. PATENT DOCUMENTS

| | | | |
|---|---|---|---|
| 3,459,235 | 8/1969 | Cauthen et al. | 139/1 R |
| 3,613,743 | 10/1971 | Saxamoto | 139/348 |
| 3,926,224 | 12/1975 | Vermeulen et al. | 139/435 |
| 3,977,441 | 8/1976 | Suaty et al. | 139/1 R |

FOREIGN PATENT DOCUMENTS

| | | | |
|---|---|---|---|
| 17385 | 10/1966 | Japan | 139/1 R |
| 533192 | 3/1973 | Switzerland | 139/1 R |

*Primary Examiner*—Henry Jaudon

*Attorney, Agent, or Firm*—Robert E. Burns; Emmanuel J. Lobato; Bruce L. Adams

[57] ABSTRACT

Herein disclosed is a method of and an apparatus for marking a woven fabric with indicia of discrete events of a predetermined nature or natures such as unit lengths of the fabric woven and the occurrences of defects in weaving such as improperly inserted picks of weft yarn, wherein picks of an index yarn or yarns are inserted into the weft-filling shed of the warp yarns concurrently with insertion of picks of the weft yarn when the occurrences of events of the predetermined nature or natures are detected during weaving of the fabric, the natures of the events being distinguished from one another by the difference between the lengths, colors, numbers or any other characteristics of the picks of the index yarn inwoven into the fabric.

35 Claims, 4 Drawing Figures

METHOD OF AND APPARATUS FOR MARKING WOVEN FABRIC WITH INDICIA DURING WEAVING OF THE WOVEN FABRIC

FIELD OF THE INVENTION

The present invention relates generally to weaving looms and, particularly, to a method of and an apparatus for making a woven fabric with indicia of the occurrences of discrete events of at least one predetermined nature, preferably of two or more predetermined natures such as predetermined unit lengths of the fabric woven and the picks of a weft yarn improperly inserted into the woven fabric during production of the fabric.

DESCRIPTION OF THE PRIOR ART

Indication of unit lengths in a woven fabric is usually performed by stamping marks in ink on the fabric woven. On the other hand, inspection of defects in a woven fabric and indication of the detected defects in the fabric are performed upon completion of the fabric. Additional steps are thus required for these purposes after weaving operations to produce woven fabrics are complete.

In consequence of various improvements which have thus far been made in the production of woven fabrics, especially in the production equipment to be used therefor, defects such as improperly inserted weft yarns rarely occur during production of woven fabrics in modernized versions of weaving machinery. Extremely meticulous efforts are therefore required the detection of such a limited number of defects in a woven fabric if such efforts are to be paid solely by human labores. If any defect occurring in a woven fabric happens to be overlooked upon manufacture of the fabric and the fabric is supplied to a commercial market before the defect is found out or removed therefrom, not only the commercial value of the product would be impared in the market but the reputation which has been credited to the products of the manufacturer might be damaged. Such risks could be avoided if the defects which have been produced in a fabric woven can be detected and indicated accurately during production of the fabric. The present invention contemplates provision of a method of and an apparatus for making a woven fabric with indicia of such defects as well as the discrete events of any other natures occurring in a woven fabric in the process of producing the fabric.

SUMMARY OF THE INVENTION

In accordance with one important aspect of the present invention, there is provided, in a weaving loom in which a woven fabric is to be produced by warp yarns forming a weft-filling shed in each weaving cycle of the loom and a pick of a weft yarn inserted into the weft-filling shed during each weaving cycle, a method of marking the woven fabric with indicia of the occurrences of discrete events of at least one predetermined nature in the fabric being woven, comprising detecting the occurrence of each of the discrete events in the fabric being woven, and inserting a pick of an index yarn into the weft-filling shed of the warp yarns in response the occurrence of each of the events detected.

More specifically, the present invention is to provide in a weaving loom of the above described general nature, a method of marking the woven fabric with indicia of the occurrences of discrete events of predetermined natures in the fabric being woven, comprising preparing at least one continuous length of index yarn for being fed to the loom from an index-yarn supply package, detecting the occurrence of each of the discrete events in the fabric being woven, producing signals each indicative of the detected occurrence of each of the discrete events and having a predetermined characteristic which is proper to the particular nature of the event detected, drawing the index yarn from the index-yarn supply package in response to each of the above mentioned signals by a predetermined length which is proper to the characteristic of each signal, and inserting the drawn length of the index yarn into the weft-filling shed.

As an alternative, the present invention provided also in a weaving loom of the above described general nature, a method of marking the woven fabric with indicia of the occurrences of discrete events of predetermined natures in the fabric being woven, comprising preparing at least two continuous lengths of index yarns for being fed to the loom from respective index-yarn supply packages, detecting the occurrence of each of the discrete events in the fabric being woven, producing signals each indicative of the detected occurrence of each of the discrete events and having a predetermined characteristic which is proper to the particular nature of the event detected, selecting one of the index yarns depending upon the particular characteristic of each of the above mentioned signals, drawing the selected index yarn from the supply package of the index yarn by a predetermined length, and inserting the drawn length of the index yarn into the weft-filling shed of the warp yarns.

In accordance with another important aspect of the present invention, there is provided, in a weaving loom in which a woven fabric is to be produced by warp yarns forming a weft-filling shed in each weaving cycle of the loom and a pick of a weft yarn inserted into the weft-filling shed during each weaving cycle, a fabric marking apparatus for marking the woven fabric with indicia of the occurrences of discrete events of predetermined natures in the fabric being woven, comprising index-yarn storage means for supplying at least one continuous length of index yarn, index-yarn retaining and inserting means operative to draw the index yarn from the storage means and inserting a pick of the index yarn into the weft-filling shed of the warp yarns when actuated, and control means responsive to the occurrences of the discrete events in the fabric being woven and operative to actuate the retaining and inserting means in response the occurrence of each of the discrete events for causing the retaining and inserting means to draw the index yarn from the storage means and insert a pick of the index yarn into the weft-filling shed depending upon the individual natures of the discrete events.

The index yarn or each of the index yarns above mentioned and for use in a method and an apparatus according to the present invention may be constituted not only by a yarn but by any thread, filament or, in general, a flexible line similar to a textile yarn.

DESCRIPTION OF THE DRAWINGS

The features and advantages of a method of and an apparatus according to the present invention will become more apparent from the following description taken in conjunction with the accompanying drawings in which like reference numerals designate corresponding or similar units, members and elements of, especially, the weaving stage of a loom and in which.

DESCRIPTION OF PREFERRED EMBODIMENTS

In each of the preferred embodiments of the apparatus according to the present invention as will be hereinafter described with reference to the drawings, only a limited number of important component elements and units of a weaving loom are illustrated but the whole construction of the loop per se will be readily understood by those skilled in the art from such component elements and units.

Figure 1:
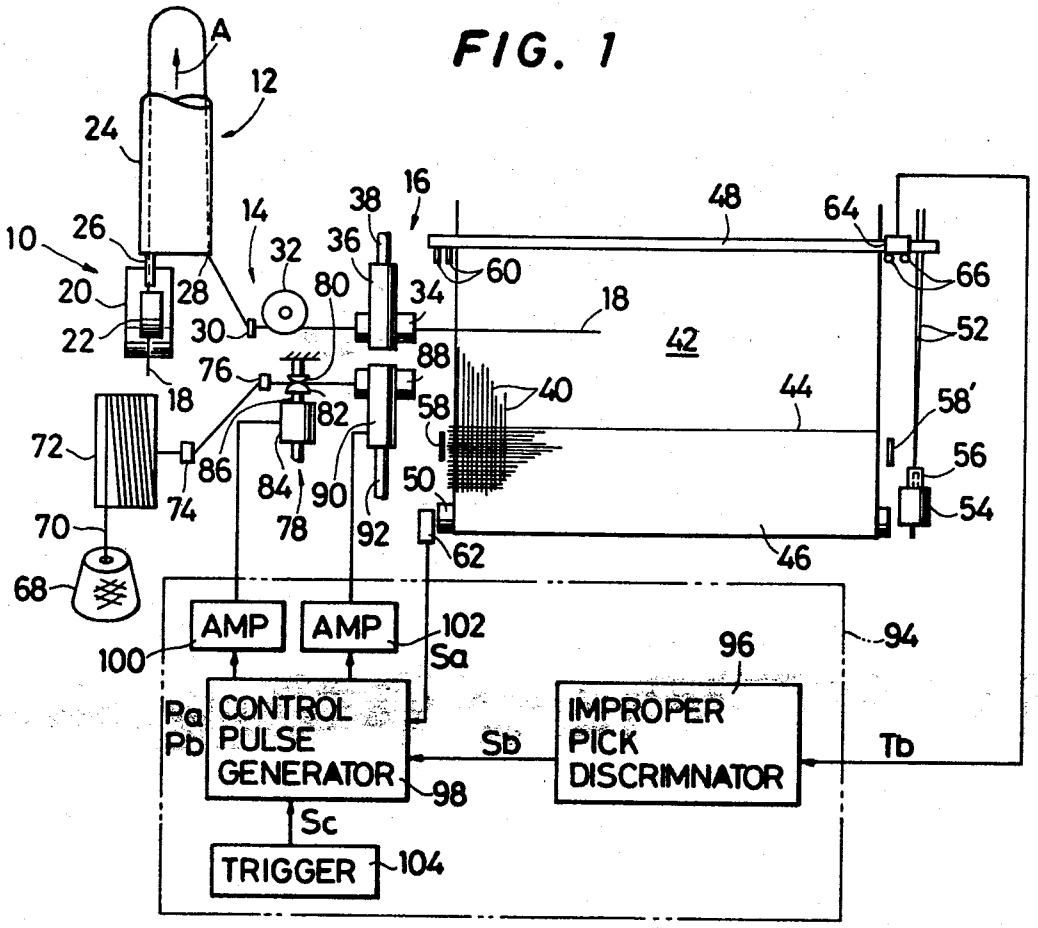
FIG. 1 is a schematic plan view showing, partially in a block diagram, a first preferred embodiment of a fabric marking apparatus according to the present invention.

Referring to the drawings, first particularly to FIG. 1, an automatic weaving loom with which a fabric marking apparatus according to the present invention is to be in use has in conjunction with the weaving stage of the loom a weft manipulating arrangement which is shown largely comprising weft draw-off and length-measuring means 10, weft detaining means 12, weft guide and clamp means 14, and weft inserting means 16. The weft draw-off and length-measuring means 10 is adapted to draw a continuous weft yarn 18 from a suitable yarn supply package (not shown) such as a cone or a bobbin carrying a roll of weft yarn and to feed a predetermined length of weft yarn to the yarn detaining means 12 in each cycle of operation of the weaving loom. Such means is shown, by way of example, as including a combination of a length-measuring roller 20 having a fixed horizontal axis of rotation and a pressing roller 22 which is positioned above the length-measuring roller 20. The pressing roller 22 has a horizontal axis substantially parallel with the axis of rotation of the length-measuring roller 20 and is vertically movable into and out of contact at its lower turning end with the length-measuring roller 20. In operation of the weaving loom, the length-measuring roller 20 is driven for rotation about the axis of rotation thereof and is held in rolling contact at its lower turning end with the length-measuring roller 20. The pressing roller 22 being thus in rolling contact with the length measuring roller 20, the pressing roller 22 is driven by the length-measuring roller 20 for rotation about the axis of the roller 22 in a direction opposite to the direction of rotation of the length-measuring roller 20. The weft yarn 18 leading from the above mentioned yarn supply package is passed between the rollers 20 and 22 so that the weft yarn 18 is pressed between the two rollers and is continuously drawn from the yarn package by a length which is dictated by the diameter of the length-measuring roller 20. The diameter of the length-measuring roller 20 is predetermined so that the length of the weft yarn 18 to be passed through the rollers 20 and 22 constituting the yarn drawn-off and length-measuring means 10 is substantially equal to the desired length of the pick of the weft yarn to be consumed in each cycle of operation of the loom.

The weft detaining means 12 is positioned posterior to the above described weft draw-off and length-measuring means 10 in the direction of advance of the weft yarn 18 from the weft draw-off and length-measuring means 10 and is shown comprising, also by way of example, a hollow yarn detaining tube 24 which is elongated in a direction substantially parallel with the direction in which the weft yarn 18 drawn off by the length-measuring and pressing rollers 20 and 22 of the yarn draw-off and length-measuring means 10 is to be conveyed past the rollers 20 and 22. The yarn detaining tube 24 has a front end located in the neighborhood of the rollers 20 and 22 and yarn inlet pipe 26 axially projects from the front end of the tube and has a foremost end located close to and directed perpendicularly toward the line of contact between the rollers 20 and 22, the line of contact being obtained when the pressing roller 22 is in rolling contact with the length-measuring roller 20 as above set out. The yarn inlet pipe 26 has an axial bore which is open throughout the length of the pipe and which is in contact communication at its rear end with the bore or axial passageway in the yarn detaining tube 24. The weft yarn 18 which has been fed from the weft draw-off and length measuring means 10 is admitted into the yarn inlet pipe 26 and then into the yarn detaining tube 24 in a direction substantially in line with the path in which the yarn 18 is withdrawn from the line of contact between the rollers 20 and 22 in rolling contact with each other. Though not shown in the drawings, the weft detaining means 12 further comprises a suitable source of suction adapted to constantly or periodically induce in the yarn detaining tube 24 a unidirectional stream of air flowing rearwardly away from the front end of the tube 24 as indicated by arrow A. That portion of the weft yarn 18 which has been introduced into the yarn detaining tube 24 through the yarn inlet pipe 26 is thus forced rearwardly within the yarn detaining tube 24. The source of suction may be constituted by a vacuum pump which is so arranged as to have its suction port open into the yarn detaining tube 24 through a rear end portion of the tube. If, desired, the air-stream inducing means may comprise, as an alternative to the source of suction, a suitable source of air under presusre such as an air compressor, a pneumatic pump or a blower which is arranged in such a manner as to constantly or periodically supply air under pressure into the yarn detaining tube 24 through the front end of the tube so that a unidirectional stream of air is induced in the yarn detaining tube 24 from the foremost end toward the rearmost end (not shown) of the axial passageway in the tube. The yarn detaining tube 24 has provided at its front end a yarn outlet opening 28 through which the weft yarn 18 which is partially admitted into the yarn detaining tube 24 is withdrawn from the tube. That portion of the weft yarn 18 which is subjected to the unidirectional stream of air in the yarn detaining tube 24 as above described is thus forced to stretch within the tube 24 in the form of a generally U-shaped open loop having its opposite ends located at the front end of the axial passageway in the tube 24 and its intermediate portion curved generally in hair-pin form close to the rearmost end of the passageway in the tube as partially indicated by dotted lines. The length of the U-shaped portion of the weft yarn 18 which is formed in this fashion within the yarn detaining tube 24 is substantially equal to the length of the weft yarn which is measured off by the weft-off and length-measuring means 10 in each cycle of operation of the loom.

On the other hand, the weft guide and clamp means 14 is provided posterior, in effect, to the above described weft detaining means 12 and is shown, also by way of example, to comprise a yarn-guide eye element 30 which is fixedly located in the neighborhood of the front end of the yarn detaining tube 24 is being capable of passing therethrough the weft yarn 18 withdrawn from the yarn outlet opening 28 of the tube 24 and a yarn clamp assembly 32 which is positioned posterior, in the direction of travel of the yarn 18, to the yarn-guide eye element 30, and which is arranged to receive the weft yarn 18 passed through the eye element 30. Though not shown in FIG. 1, the yarn clamp assembly 32 comprises two clamp members consisting of a stationary clamp member which is fixed on or otherwise stationary with respect to the frame structure of the loom and a movable clamp member which is vertically movable into and out of contact with the stationary clamp member. The movable clamp member is urged by suitable biasing means (not shown) to move toward the position contacting the stationary clamp member and is operatively connected to suitable actuating means arranged to be operated by suitable intermittent-motion drive means so that the movable clamp member is actuated to move away from the stationary clamp member against the action of the above mentioned biasing means during each cycle of operation of the loom. When the movable clamp member is thus moved out of contact with the stationary clamp member, the weft yarn 18 which is passed between the two clamp members is free to travel through the clamp assembly 32 insofar as the yarn has a portion received in the yarn detaining tube 24. When, however, the movable clamp member is held in contact with the stationary clamp member, the weft yarn 18 is in part pressed upon between the two clamp members and is disabled from being paid away from the clamp assembly 32.

The weft manipulating arrangement of the weaving loom wherein exemplified is assumed to be of a fluid-jet type and, thus, the weft inserting means 16 of the loom is shown comprising a fluid-jet nozzle 34 having a fluid-flow shut-off valve assembly 36 which is in communication with a suitable source of fluid under pressure such as a power-driven air-compressor or water-displacement pump (not shown) through a fluid-feed pipe or conduit 38 so that the fluid under pressure is ejected from the nozzle 34 when the valve assembly 36 is open. The fluid-jet nozzle 34 has a yarn inlet end located substantially in line with the path of the weft yarn 18 to travel away from the above described yarn clamp assembly 32 and a yarn shooting end located in conjunction with the weaving stage of the loom.

In the weaving stage of the loom, two angularly spaced webs of warp yarns 40 fed from, for example, a warp beam (not shown) positioned rearwardly of the weaving stage are alternately raised and lowered across a horizontal center plane for forming between the two webs of the warp yarns 40 a weft filling shed 42 closing at the fell 44 of the woven fabric or cloth 46 formed in front of the shed 42 as is well known in the art. The alternate upward and downward movements of the webs of the warp yarns 40 are effected by means of a number of healds (not shown) each having an eye passing each of the warp yarns 40 therethrough and driven for vertical movement during each cycle of operation of the loom. A reed 48 is positioned in front of these healds and substantially in parallel with the shed 42 of the warp yarns 40 and is movable toward and away from the fell 44 of the woven fabric 46. The reed 48 is constructed by a comb-like arrangement of flattened wires or dents (not shown) supported by an outer frame structure and forming therebetween a number of vertical slots through which the individual warp yarns 40 are passed toward the fell 44 of the woven fabric 46. The above mentioned horizontal center plane between the webs of the warp yarns 40 contains a warp line which is parallel with the fell 44 of the woven fabric 46 and which extends throughout the width of the weft-filling shed 42 of the warp yarns 40. The yarn outlet end of the above described fluid-jet nozzle 34 of the weft inserting means 16 is substantially aligned with this warp line. Though not shown in the drawings, the fluid-flow shut-off valve assembly 36 for the fluid-jet nozzle 34 is operatively connected to suitable valve actuating means arranged to be operated by the previously mentioned intermittent-motion drive means so that the valve 36 assembly is actuated to open during each cycle of operation of the loom. The fluid-flow shut-off valve assembly 36 is opened up simultaneously as the yarn clamp assembly 32 of the weft guide and clamp means 14 is actuated to open so that the weft yarn 18 released from the clamp assembly 32 is entrained on the jet stream of the fluid ejected from the yarn shooting end of the nozzle 34 and is shot into the shed 42 of the warp yarns 40. The yarn clamp assembly 32 and the fluid-flow shut-off valve assembly 36 are kept open concurrently for a predetermined period of time until the measured length of the weft yarn 18 which has been stored in the yarn detaining tube 24 is consumed. The length of the weft yarn 18 to be stored in the yarn retaining tube 24 or, in other words, to be drawn from the yarn supply package by means of the length-measuring and pressing rollers 20 and 22 of the weft draw-off and length-measuring means 10 should thus be such that the pick of the weft yarn 18 shot into the shed 42 of the warp yarns 40 through one lateral end of the shed 42 is enabled to travel beyond the other lateral end of the shed 42. Upon termination of the shooting of the weft yarn 18 into the shed 42, the reed 48 which has been positioned rearwardly of the warp line within the shed 42 of the warp yarns 40 is driven to move forwardly and beats up the pick of the weft yarn 18 onto the fell 44 of the woven fabric 46 so that the pick of the weft yarn 18 which has been inserted into the weft filling shed 42 is closely interwoven with the warp yarns 40 as is well known in the art. The reed 48 is thereafter moved back to be ready for the subsequent weaving cycle of operation. The fabric 46 is thus formed by the successive picks of weft yarn 18 interwoven with the warp yarns 40 is stepwise would on a take-up roller 50 which has a center axis substantially parallel with the fell 44 of the woven fabric 46 and which is cyclically driven for rotation about the center axis in synchronism with the cycles of operation of the loom.

The weaving stage of the loom further comprises weft anchoring means which is arranged in such a manner that the pick of the weft yarn 18 which has been shot across the weft filling shed 42 of the warp yarns 40 is captured at its leading end by and between two sets of weft retaining yarns 52 extending in parallel with the warp yarns 40. The weft retaining yarns 52 are passed through the eyes in healds (not shown) which are arranged similarly to the healds for the warp yarns 40 so that the two sets of weft retaining yarns 52 are alternately raised and lowered simultaneously when the two webs of the warp yarns 40 are raised and lowered across the previously mentioned warp line between the webs, the thereby forming between the weft retaining yarns 52 a shed which is substantially aligned with the shed 42 formed by the warp yarns 40. The reed 48 has a widthwise coverage not only for the warp yarns 40 but for the weft retaining yarns 52, which are thus also passed through the vertical slots between the dents of the reed 48, as will be seen from the arrangement schematically illustrated in FIG. 1.

To have the pick of the weft yarn 18 captured at its leading end by these weft retaining yarns 52, the weft anchoring means comprises a twisting assembly 54 which is positioned in the vicinity of the opposite lateral end of the fell 44 of the woven fabric 46 to the fluid-jet nozzle 34 of the weft inserting means 16 and which includes a rotor 56 rotatable about an axis substantially parallel with the direction in which the woven fabric 46 is to be conveyed forwardly away from the fell 44 thereof. The rotor 56 is formed with an axial bore through which the weft retaining yarns 52 are passed forwardly from the twisting assembly 54 and are twisted on one another into a single thread as the rotor 56 is driven to turn about the axis thereof. The single thread thus formed forwardly of the twisting assembly 54 is conveyed forwardly at substantially the same velocity as the velocity at which the woven fabric 46 is advanced away from the weaving stage of the loom. The weft yarn 18 shot across the weft filling shed 42 of the warp yarns 40 is first loosely received between the two sets of weft retaining yarns 50 at its leading end beyond the opposite lateral end of the shed 42 opposite to the weft inserting means 16 and has its leading end portion entwined between the two sets of weft retaining yarns 50 which are on the point of being twisted on one another in the vicinity of the lateral end of the fell 44 of the woven fabric 46. Each pick of the weft yarn 18 which has been properly inserted into the weft filling shed 42 of the warp yarns 40 is and which has thus reached to the weft retaining yarns 52 beyond the foremost lateral end of the shed 42 from the fluid-jet nozzle 34 of the weft inserting means 16 thus caught at its leading end by the weft retaining yarns 50 which are being twisted on one another anterior to the rotor 56 of the twisting assembly 54. Upon termination of the weft picking operation each cycle of operation of the loom, the yarn clamp assembly 32 of the weft guide and clamp means 14 is closed with its movable clamp member moved into contact with the stationary clamp member of the assembly so that the pick of the weft yarn 18 passed through the weft filling shed 42 is retained at one end of the pick to the yarn clamp assembly 32 and at the other end to the weft retaining yarns 52 and is given a tension between these ends when moved forwardly and beaten up onto the fell 44 of the woven fabric 46 by the reed 48.

The weaving stage of the loom further comprises weft cutting means which is adapted to cut the pick of the weft yarn 18 at or in proximity to the lateral ends or the selvages of the fell 44 of the woven fabric 46. Such cutting means is shown comprising electrically-heated stationary yarn cutting elements 58 and 58' which are respectively located adjacent the opposite lateral ends of the fell 44 of the woven fabric 46 and a pair of spaced parallel yarn pressing elements 60 which are fixedly mounted on the reed 48 in association with the yarn cutting element 58 provided adjacent one lateral end of the fell 44 of the woven fabric 46. When the reed 48 is moved forward upon termination of the picking operation in each weaving cycle of operation and beats up the pick of the weft yarn 18 against the fell 44 of the woven fabric 46 as above described, the yarn pressing elements 60 on the reed 48 having the pick of the weft yarn received on its front face are brought into engagement with the yarn cutting element 58 and have the cutting element loosely interposed between the two pressing elements 60 with one end portion of the pick of the weft yarn 18 forced against the cutting element 58 by the pressing elements 60. The particular end portion of the pick of the weft yarn 18 is cut off from the remainder of the pick of the weft yarn by the heat of the yarn cutting element 58 which is electrically energized from an external power source (not shown). The cutting means further comprises yarn pressing elements associated with the cutting element 58 disposed adjacent the other lateral end of the fell 44 of the woven fabric 46. Such yarn pressing elements will be described later.

The construction and arrangement of the weaving loom which has been described hereinbefore is well known in the art of textile production and is merely representative of known weaving looms to which the present invention is applicable. The following description regarding the embodiment of the present invention should therefore be perused and construed with this in mind.

The fabric marking apparatus provided in the weaving loom constructed and arranged as above described is shown to comprise index-yarn storage means storing a continuous length of index yarn, index-yarn guide means for guiding the index yarn to be drawn out from the index-yarn storage means in a predetermined path, index-yarn retaining means operative between a condition having retained thereto the index-yarn leading from the storage means by way of the above mentioned guide means and thereby prohibiting the index yarn from being passed through the retaining means in a direction to advance away from the retaining means toward the weaving stage of the loom and a condition allowing the index yarn to advance in the above mentioned direction, index-yarn inserting means which is capable of having admitted thereto the index yarn advancing from the retaining means and which is operative to insert the index yarn into the weft filling shed 42 between the webs of the warp yarns 40 in the weaving stage of the loom, detecting means for detecting occurrences of discrete events of predetermined natures in the fabric 46 being woven in the weaving stage of the loom and producing output signals representative of such occurrences and indicative of the natures of the events detected, and control means operatively connected to the index-yarn retaining and inserting means and responsive to each of the signals from the above mentioned detecting means for actuating the index-yarn clamp and inserting means to pass the index yarn through the retaining means and to insert the yarn into the weft filling shed 42 of the warp yarns 40 to a length which is predetermined for each of the aforesaid natures of the events. In the embodiment shown in FIG. 1, the events whose occurrences are to be detected by the above mentioned detecting means are assumed, by way of example, to be the intervals at which a predetermined unit length of woven fabric is produced in the loom and the picks of the weft yarn 18 which are improperly shot into the weft filling shed 42 of the warp yarns 40 in the weaving stage of the loom. Thus, the detecting means provided in the embodiment illustrated in FIG. 1 is shown comprising a weaving-rate detector 62 disposed in conjunction with the take-up roller 50 of the loom and an improper-pick detector 64 which is mounted on the reed 48 in the weaving stage of the loom. The weaving-rate detector 62 is responsive to the number of the turns of the take-up roller 62 about the center axis thereof and is operative to produce an output signal Sa each time the take-up roller 50 has made a predetermined number of the turns about its axis during operation of the loom. The predetermined number of turns of the take-up roller 50 is in correspondence with the predetermined unit length of the woven fabric 46 which has been wound on the roller 50, viz., of the woven fabric 46 which has been conveyed away from the fell 44 of the fabric toward the take-up roller 50. The weaving-rate detector 62 is, thus, adapted to deliver its output signals Sa at time intervals each representative of the predetermined unit length of the fabric 46 produced in the weaving stage of the loom. On the other hand, the improper-pick detector 64 is adapted to produce an output signal Tb in the event a pick of the weft yarn 18 is shot from the fluid-jet nozzle 34 of the weft inserting means 16 into the weft filling shed 42 of the warp yarns 40 but has failed to reach to the weft retaining yarns 52 beyond the opposite lateral end of the shed 42 or has reached the weft retaining yarns 52 in a slackened condition. For this purpose, the improper-pick detector 64 is fixedly mounted on the reed 48 in proximity to the weft retaining yarns 52 passed through the reed 48 and has a pair of electrodes 66 which extend on the front side of the reed 48 downwardly from the top cross member of the frame structure of the reed 48 and which are spaced apart from each other in parallel with the webs of the warp yarns 40 and the weft retaining yarns 52 as will be seen from FIG. 1. Though not seen in the drawing, the electrodes 66 are electrically insulated from each other in the detector 64 and have lower end portions located adjacent to the path of the pick of the weft yarn 18 to be shot across the sheds of the warp yarns 40 and the weft retaining yarns 52 so that the pick of the weft yarn 18 which is shot from the fluid-jet nozzle 34 beyond the opposite lateral end of the weft filling shed 42 of the warp yarns 42 and properly captured at its leading end by the weft retaining yarns 52 is received on the front ends of the electrodes 66. When the two electrodes 66 are thus contacted by the pick of the weft yarn 18 shot across the sheds of the warp yarns 40 and the weft retaining yarns 52, electrical connection is provided between the electrodes 66 through that portion of the weft yarn 18 which intervenes between the electrodes because of the conductivity of the yarn 18. The output signal Tb of the improper-pick detector 64 is produced as a result of the electrical connection provided between the electrodes 66 of the detector 64. The electrodes 66 of the improper-pick detector 64 thus constitute stationary contact elements of normally-open switch means and the pick of the weft yarn 18 properly shot across the sheds of the warp yarns 40 and the weft retaining yarns 52 serves as a movable contact element for the switch means. A known example of the improper-pick detecting means of this nature is disclosed in detail in U.S. Pat. No. 3,967,656. This issued Patent also shows detecting means operable as the above described weaving-rate detector 62.

In the arrangement illustrated in FIG. 1, the electrodes 66 of the improper-pick detector 64 are located in conjunction with the electrically-heated yarn cutting element 58' located in proximity to the opposite lateral end of the fell 44 of the woven fabric 46 to the fluid jet nozzle 34 so that the leading end portion of the pick of the weft yarn 18 beaten up onto the fell 44 by the reed 48 is pressed against the cutting element 58' and is cut off from the remainder of the pick. Thus, the electrodes 66 serve not only as the movable contact elements in the improper-pick detector 64 but as the yarn pressing elements associated with the cutting element 58'.

The previously mentioned index-yarn storage means of the fabric marking apparatus shown in FIG. 1 comprises a suitable index-yarn supply package 68 consisting of a continuous length of index yarn 70 which is wound in the form of, for example, a cone as shown, and a drum 72 which is rotatable on a stationary shaft (not shown) and on which the index yarn 70 which has been drawn out from the index-yarn supply package 68 is wound a desired number of turns. The yarn unwound from the rotatable drum 72 is passed through the index-yarn guide means comprising stationary yarn-guide eye elements 74 and 76 which are suitably located in the desired path of the index yarn 70 to travel away from the rotatable drum 72. Each of the eye elements 74 and 76 and the shaft supporting the drum 72 may be fixedly mounted on the frame structure (not shown) of the loom or may be secured to any member which is stationary with respect to the frame structure of the loom.

The index-yarn retaining means forming further part of the fabric marking apparatus shown in FIG. 1 comprises a solenoid-operated clamp assembly 78 having a stationary clamp member 80 which is fixedly attached to the frame structure of the loom and a movable clamp member 82 which is movable into and out of contact with the stationary clamp member 80. The clamp assembly 78 further has a solenoid unit 84 having a casing fixedly mounted on the frame structure and including a core plunger 86 which is securely connected to or integral with the movable clamp member 82 and which is coactive with a solenoid coil (not shown) incorporated into the casing of the solenoid unit for being moved inwardly into the casing and thereby causing the movable clamp member 82 to move away from the stationary clamp member 80 when the solenoid coil is energized from an external power source (not shown). The solenoid unit 84 further has suitable biasing means (not shown) urging the core plunger 86 to axially produce outwardly from the casing of the unit so that the movable clamp member 82 is biased to move for contact with the stationary clamp member 80. The solenoid-operated clamp assembly 78 is thus operative to have its movable clamp member 82 held in contact with the stationary clamp member 80 when the solenoid coil in the assembly remains de-energized and out of engagement with the stationary clamp member 80 when the solenoid coil is energized. The index-yarn 70 leading from the yarn-guide eye elements 74 and 76 is passed between the stationary and movable clamp members 80 and 82 so that, when the solenoid unit 84 of the clamp assembly 78 is being energized and as a consequence the movable clamp member 82 is held in contact with the stationary clamp member 80 as shown, the index yarn 70 extending past the yarn-guide eye element 76 is pressed upon between the clamp members 80 and 82 and is prohibited from being passed through the clamp members 80 and 82 in a direction to advance away from the clamp members, viz., toward the weaving stage of the loom. When the solenoid unit 84 is being energized to hold the movable clamp member 82 spaced apart from the stationary clamp member 80, the index yarn 70 is allowed to advance toward the weaving stage of the loom away from the clamp members 80 and 82. The index yarn thus passed through the clamp members 80 and 82 is fed to the index-yarn inserting means previously mentioned.

In the embodiment illustrated in FIG. 1, the index-yarn inserting means is assumed by way of example to be of a fluid-jet type similar in effect to the previously described weft inserting means 16 and is, thus, shown to comprise an index-yarn shooting fluid-jet nozzle 88 and a solenoid-operated valve assembly 90. The index-yarn shooting fluid-jet nozzle 88 is held in position in parallel with the fluid-jet nozzle 34 of the weft inserting means 16 and in the neighborhood of one lateral end of the fell 44 of the woven fabric 46 and, similarly to the weft shooting fluid-jet nozzle 34, has a yarn inlet end located substantially in line with the path of the index yarn 70 to travel from the clamp members 80 and 82 and a yarn shooting end located in proximity to one lateral end of the weft filling shed 42 of the warp yarns 40 and directed toward the shed 42 substantially in parallel with the fell 44 of the woven fabric 46. Preferably, the yarn inlet and shooting ends of the nozzle 88 are located to be substantially flush with the previously mentioned horizontal center plane between the webs of the warp yarns 40 in the weaving stage of the loom and, more preferably, so located as to be substantially in line with the path of the index yarn 70 to travel from the yarn-guide eye element 76 adjacent to the clamp members 80 and 82 toward the yarn inlet end of the nozzle 88 through the clamp members as shown. Though not shown in the drawings, the solenoid-operated valve assembly 90 for the index-yarn shooting fluid-jet nozzle 88 has a fluid inlet port communication with a source of fluid under pressure through a fluid-feed pipe or conduit 92 and a fluid outlet port in communication with the nozzle 88. When the valve assembly 90 is open, communication is established between the fluid inlet and outlet ports of the valve assembly 90 so that the fluid under pressure supplied from the above mentioned source is fed through the valve assembly 90 into the index-yarn shooting fluid-jet nozzle 88 and is ejected from the yarn shooting end of the nozzle 88 into the weft filling shed 42 of the warp yarns 40. The source of the fluid under pressure which is fed to the index-yarn shooting fluid-jet nozzle 88 may be provided in addition to the source of the fluid for the weft shooting fluid-jet nozzle 34 or may be constituted by the same unit as constituting the latter. The solenoid-operated valve assembly 90 has incorporated therein a suitable spring (not shown) by means of which the valve assembly 90 is biased to close. The valve assemby 90 is thus held closed when the solenoid coil also incorporated into the valve remains de-energized. When the solenoid coil of the valve assembly 90 is energized from an external power source (not shown), then the valve is actuated to open and provides communication between the source of the fluid under pressure and the index-yarn shooting fluid-jet nozzle 88 as above described.

The solenoid-operated clamp assembly 78 and the solenoid-operated valve assembly 88 are energized and de-energized under the control of the previously mentioned control means in response to the signals which are to be delivered respectively from the weaving-rate detector 62 and the improper-pick detector 64. In the embodiment illustrated in FIG. 1, the control means is shown to be constituted by an electric control circuit 94 comprising an improper-pick discriminating circuit 96, a control pulse generator 98 and first and second amplifiers 100 and 102 which are connected in parallel to the output terminal of the control pulse generator 98. The improper-pick discriminating circuit 96 is connected across the improper-pick detector 64 on the reed 48 and is adapted to produce an output signal Sb in response to the signal Tb which is produced by the improper-pick detector 66 when the pick of the weft yarn 18 shot into the weft filling shed 42 of the warp yarns 40 has failed in producing electrical connection or has failed to establish stable electrical connection between the electrodes 66 of the detector 64 during any cycle of operation of the loom. The control pulse generator 98 has at least three input terminals consisting of a first input terminal connected to the weaving-rate detector 62, a second input terminal connected to the improper-pick discriminating circuit 96, and a third input terminal connected to a suitable trigger circuit 104 which is responsive to the timings at which the weft yarn 18 is to be shot from the fluid-jet nozzle 34 of the weft inserting means 16 into the weft filling shed 42. The control pulse generator 98 is arranged in such a manner as to produce a pulse Pa having a first predetermined duration or pulswidth in response to the output signal Sa from the weaving-rate detector 62 and a pulse Pb having a second predetermined duration or pulsewidth in response to the output signal Sb from the improper-pick discriminating circuit 96, the first predetermined duration or pulsewidth being longer than the second predetermined duration or pulsewidth. By way of example, it is herein assumed that the respective durations of the pulses Pa and Pb produced by the control pulse generator 98 are such that the first predetermined duration of the pulse Pa substantially doubles the second predetermined duration of the pulse Pb. The control pulse generator 98 has incorporated therein suitable memory means which is arranged in such a manner that the input signal Sa or Sb from the weaving rate detector 62 or the improper-pick discriminating circuit 96 is temporarily stored in the pulse generator 98 until an output signal Sc is issued from the trigger circuit 104 and impressed on the pulse generator 98. The control pulse generator 98 thus becomes ready to produce the output pulse Pa or Pb in response to the input signal Sa or Sb, respectively, delivered from the weaving-rate detector 62 or the improper-pick discriminating circuit 96 in any of the cycles of operation of the loom and delivers the output pulse Pa or Pb in response to the signal Sc fed to the pulse generator from the trigger circuit 104 in the subsequent cycle of operation of the loom. Though not shown in the drawings, the memory means to achieve the above described function may comprise first and second flip-flop circuits which have their respective set terminals connected to the weaving-rate detector 62 and the improper-pick detector 64. The output terminal of each of the first and second flip-flop circuits is connected to one input terminal of a two-input AND-gate circuit having its output terminal connected to the input terminal of monostable multivibrator. The monostable multivibrators thus connected in parallel to the first and second flip-flop circuits through the respectively associated AND-gate circuits are so designed that the monostable multivibrator connected to the first flip-flop circuit is operative to produce an output pulse having a pulsewidth substantially doubling the pulsewidth of an output pulse to be produced by the multivibrator connected to the second flip-flop circuit. The other input terminals of the two AND-gate circuits are connected in parallel to the output terminal of the above mentioned trigger circuit 104 so that each of the monostable multivibrators in enabled to deliver an output pulse thereof in response to the signal Sc fed to each of the AND-gate circuits after the associated flip-flop circuit has been supplied with an input signal Sa or Sb from the weaving-rate detector 62 or the improper-pick discriminating circuit 96, respectively. The output terminals of the AND-gate circuits are connected to the respective reset terminals of the flip-flop circuits as well so that the signal Sa or Sb impressed on the first or second flip-flop circuit is cleared upon delivery of an output signal from the AND-gate circuit associated with the flip-flop circuit. The respective output terminals of the monostable multivibrators are connected to the input terminals of a two-input OR-gate circuit so that, when at least one of the monostable multivibrators is in a condition delivering its output pulse, the pulse is passed through the OR-gate circuit and is delivered to each of the previously mentioned amplifiers 100 and 102 as the pulse Pa or Pb. The respective durations of the pulses Pa and Pb to be delivered from the control pulse generator 98 are thus determined by the pulsewidths produced by the above mentioned monostable multivibrators and can therefore be selected arbitarily by selecting the respective time constants of the multivibrators. The above described example of the control pulse generator 98 is merely by way of example and, therefore, the pulse generator 98 may be constructed and arranged in any desired manner insofar as pulses Pa and Pb of the described general natures can be produced from the pulse generator in response to the signals Sa and Sb, respectively, impressed thereon. The first and second amplifiers 100 and 102 have their respective output terminals connected to the respective solenoid coils of the clamp and valve assemblies 78 and 90, respectively, as shown.

The improper-pick discriminating 96 is required mainly for the purpose of discriminating from proper picks of the weft yarn from those improper picks of the weft yarn which have reached to the electrodes 66 of the improper-pick detector 64 on the reed 48 but have failed to reach the weft retaining yarns 52 or to establish stable electrical connection between the electrodes 66 of the detector 64 for, for example, lack of tension in the picks of the yarns shot into the weft filling shed 42 of the warp yarns 40. Thus, the improper-pick discriminating circuit 96 may comprise a logic inverter having an input terminal connected across the electrodes 66 of the improper-pick detector 64 and an output terminal connected to one input terminal of a two-input AND-gate circuit, though not shown in the drawing. The other input terminal of the AND-gate circuit is connected to a suitable timing circuit adapted to produce a train of pulses synchronized with the timings at which picks of the weft yarn 18 are shot from the weft shooting fluid jet nozzle 34 of the loom so that the AND-gate circuit is conditioned to produce the above mentioned output signal Sb in the presence of a logic "0" signal at the input terminal of the above mentioned logic inverter and a logic "1" signal at the output terminal of the timing circuit. The timing circuit may be constituted by the trigger circuit 104 of the above described control circuit 94. An example of the improper-pick discriminating circuit 96 to achieve the above described general function is also disclosed in U.S. Pat. No. 3,967,656 previously referred to.

Description will now be made regarding the modes of operation of the fabric marking apparatus thus constructed and arranged.

Throughout operation of the weaving loom, the weaving-rate detector 62 produces a train of signals Sa at intervals each corresponding to the predetermined unit length of the woven fabric 46 produced in the weaving stage of the loom and the trigger circuit 104 produces a train of signals Sc at timings synchronized with the timings at which picks of the weft yarn 18 are shot from the weft shooting fluid-jet nozzle 34 into the weft filling shed 42 of the warp yarns 40. Each of the signals Sa thus delivered in succession to the control pulse generator 98 of the control circuit 94 is stored temporarily in the pulse generator 98 until the pulse generator is supplied with an output signal Sc from the trigger circuit 104. The signal Sc is delivered from the trigger circuit 104 at an incipient stage of the cycle of operation of the loom subsequent to the cycle of operation during which the signal Sa is delivered from the weaving-rate detector 62. In response to the signal Sc from the trigger circuit 104, the control pulse generator 98 is made operative to deliver an output pulse Pa having the previously mentioned first predetermined duration to each of the first and second amplifiers 100 and 102. The output pulse Pa from the control pulse generator 98 is thus fed, upon amplification by the amplifiers 100 and 102, to the respective solenoid coils of the solenoid-operated clamp assembly 78 and the solenoid-operated valve assembly 90. The solenoid coil of the clamp assembly 78 being thus energized, the core plunger 86 of the solenoid unit 84 of the assembly 78 is caused to retract backwardly and moves the movable clamp member 82 away from the stationary clamp member 80, thereby releasing the index yarn 70 from the clamp members 80 and 82 and allowing the index yarn to travel through the clamp members 80 and 82 toward the yarn inlet end of the index-yarn shooting fluid-jet nozzle 88. Simultaneously when the index-yarn clamp assembly 78 is thus initiated into motion, the solenoid coil of the solenoid-operated valve assembly 90 is energized by the pulse Pa amplified by the second amplifier 102 so that the valve assembly 90 is rendered open to provide communication between the source of the fluid under pressure and the index-yarn shooting fluid-jet nozzle 88. While the index-yarn clamp and valve assemblies 78 and 90 are being actuated in these manners by the amplified versions of the pulse Pa, the clamp assembly 32 and the fluid-flow shut-off valve assembly 36 of the weft manipulating arrangement are also initiated into motion to permit the weft yarn 18 to pass through the clamp assembly 32 and the weft shooting fluid-jet nozzle 34 to communicate with the source of the fluid under pressure. Jet streams of the fluid under pressure are thus ejected concurrently from the weft and index-yarn fluid-jet nozzles 34 and 88 into the weft-filling shed 42 of the warp yarns 40 with the result that the index yarn 70 entrained on the jet stream of the fluid spurting from the yarn shooting end of the index-yarn shooting fluid-jet nozzle 88 is inserted into the shed 42 of the warp yarns 40 along with the pick of the weft yarn 18 which is entrained on the jet stream of the fluid under pressure spurting from the weft shooting fluid-jet nozzle 34. The pick of the weft yarn 18 thus shot into the weft filling shed 42 of the warp yarns 40 is passed through the shed 42 toward the shed between the weft retaining yarns 52 located beyond the opposite lateral end of the shed 42 to the nozzle 34. On the other hand, the pick of the index yarn shot from the index-yarn shooting fluid-jet nozzle 88 travels through the weft filling shed 42 as long as the nozzle 88 remains operative to eject the jet stream of the fluid therefrom. The index yarn 70 is thus inserted into the weft filling shed 42 of the warp yarns 40 over a distance which corresponds to the period of time for which the index-yarn shooting fluid-jet nozzle 88 is held operative. The clamp and valve assemblies 78 and 90 of the fabric marking apparatus being kept energized for a period of time which is substantially equal to the duration of the pulse Pa delivered from the control pulse generator 98, the pick of the index yarn 70 on the jet stream of the fluid spurting from the fluid jet nozzle 88 ceases flying within the weft filling shed 42 when the pulse Pa from the control pulse generator 98 terminates. If, therefore, the index-yarn shooting fluid jet nozzle 88 is positioned to have its yarn shooting end located close to the adjacent lateral end of the weft filling shed 42 of the warp yarns 40, the length of the pick of the index yarn 70 which is shot into the shed 42 is approximately proportional to the duration or pulsewidth of the output pulse Pa delivered from the control pulse generator 98. The pick of the index yarn 70 properly shot into the weft filling shed 42 of the warp yarns 40 is first loosely interwoven with the warp yarns 40 and is thereafter beaten up by the reed 48 against the fell 44 of the woven fabric 46 together with the pick of the weft yarn 18 which has also been shot into the shed 42 of the warp yarns 40. The picks of the weft and index yarns 18 and 70 now forming part of the woven fabric 46 are cut off from the respective remainders of the yarns 18 and 70 by means of the electrically-heated yarn cutting elements 58 and 58' which are engaged by the yarn pressing elements 60 and 66, respectively, on the reed 48 moved onto the fell 44 of the woven fabric 46. The woven fabric 46 formed in the weaving stage of the loom is in these manners interwoven with a cut segment of the index yarn 70 as an indicium of the predetermined length of the woven fabric 46 which has been conveyed away from the fell 44 of the fabric 46 and wound on the take-up roller 50 during operation of the loom. Upon completion of the weft picking operation in each cycle of operation of the loom, the pressing roller 22 of the weft draw-off and length-measuring means 10 is driven into rolling contact with the length-measuring roller 22 so that the weft yarn 18 is drawn a predetermined length through the rollers 20 and 22 into the yarn detaining tube 24 with the agency of the unidirectional stream of air which is constantly established or periodically induced in the tube 24 as previously noted.

In the event it happens that a pick of the weft yarn 18 has failed to cover the entire width of the weft filling shed 42 of the warp yarns 40 and thus reach to the weft retaining yarns 52 beyoned the opposite lateral end of the shed 42 or has reached the weft retaining yarns 52 in a slackened condition by one cause or another as invited in the weft manipulating arrangement, the particular pick of the weft yarn 18 is unable to produce stable electrical connection between the electrodes 66 of the improper-pick detector 64 on the reed 48. When this occurs, the improper-pick detector 64 produces an output signal Tb and as a consequence the improper-pick discriminating circuit 96 connected to the output terminal of the detector 64 delivers an output signal Sb to the control signal generator 98 during the particular cycle of operation in which the improper picking is caused. The signal Sb is temporarily stored in the control pulse generator 98 until a signal Sc is fed to the pulse generator 96 from the trigger circuit 104 at an incipient stage of the subsequent cycle of operation. In response to the signal Sc thus fed from the trigger circuit 104, the control pulse generator 98 is actuated to deliver an output pulse Pb having the previously mentioned second predetermined duration to each of the first and second amplifiers 100 and 102. The output signal Pb of the control pulse generator 98 is upon amplification by the amplifiers 100 and 102 supplied to the respective solenoid coils of the solenoid-operated clamp and valve assemblies 78 and 90, which are accordingly actuated to pass the index yarn 70 through the clamp assembly 78 and to enable the index-yarn shooting fluid-jet nozzle 88 to eject a jet stream of the fluid under pressure into the weft filling shed 42 of the warp yarns 40. While the index-yarn clamp and valve assemblies 78 and 90 are being thus actuated by the amplified versions of the pulse Pb, the clamp and valve assemblies 32 and 36 of the weft manipulating arrangement are also initiated into motion so that the pick of the index yarn 70 entrained on the jet stream of the fluid from the index-yarn shooting fluid-jet nozzle 88 is shot into the weft filling shed 42 of the warp yarns 40 together with the pick of the weft yarn 18 which is entrained on the jet stream of the fluid from the weft shooting fluid-jet nozzle 34. The clamp and valve assemblies 78 and 90 of the index-yarn manipulating arrangement are kept energized for a period of time which is substantially equal to the duration of the pulse Pb delivered from the control pulse generator 98 and, accordingly, the index yarn 70 is inserted into the weft filling shed 42 of the warp yarns 40 over a distance corresponding to the duration of the pulse Pb from the lateral end of the shed 42 adjacent to the nozzle 88 by the point of time at which the nozzle 88 ceases ejection of the fluid therefrom. The length of the index yarn 70 shot into the weft filling shed 42 of the warp yarns 40 is thus substantially proportional to the duration of the pulse Pb from the control pulse generator 98 with the index-yarn shooting fluid-jet nozzle 88 positioned to have its yarn shooting end located close to the adjacent lateral end of the shed 42. The duration or pulsewidth of the pulse Pb being assumed to be half as long as the duration or pulsewidth of the pulse Pa as previously mentioned, the length of the index yarn 70 which is inserted into the woven fabric 46 in response to the output pulse Pb of the control pulse generator 98 is substantially one half of the length of the index yarn 70 which is inserted into the woven fabric 46 in response to the output signal Pa of the control pulse generator 98. If, therefore, the index yarn 70 is inserted with a length of, for example, 10 cm into the woven fabric 46 each time the fabric 46 is woven to a predetermined unit length of, for example, 50 meters, then the pick of the index yarn 70 inserted into the woven fabric 46 in response to an occurrence of improper picking in the weaving stage of the loom measures 5 cm in length. The embodiment of the fabric marking apparatus illustrated in FIG. 1 is thus adapted to insert the index yarn 70 into the woven fabric 46 with different lengths depending upon the natures of the discrete events which take place in the loom.

The natures of the discrete events which have occured on the fabric completed are, accordingly, known from one another from the lengths of the individual inserts of the index yarn in the fabric, the longer inserts being indicative of the predetermined unit length of the fabric and the shorter inserts being indicative of the occurrences, if any, of the picks of weft yarn which are short of the full width of the fabric or otherwise improperly inserted warp yarns contained in the fabric. To provide ease of discriminating such inserts of the index yarn, it is preferable that the index yarn 70 for use in the embodiment of FIG. 1 be of a color which is different from or clearly contrasting to the color or colors of the weft yarn or yarns to be in use or to the color or colors of the warp and weft yarns to form the fabric.

As the index yarn 70 is from time inserted into the woven fabric 46 which is being formed in the weaving stage of the loom, the index yarn is drawn out in succession from the rotatable drum 72 of the index-yarn storage means and accordingly the stock of the index yarn 70 on the drum 72 is stepwise consumed as the weaving operation proceeds. Replenishment of the index yarn 70 onto the drum 72 to make up for the gradual or full consumption of the stook on the drum 72, may be effected either by manually driving the drum 72 to rotate on the shaft of the drum or by the use of any powered drive means which may be operatively connected between the drum 70 and the output terminal of the first amplifier 100 of the control circuit 94 so that an additional length of the index yarn 70 is fed from the index-yarn supply package 68 to the drum 72 at suitable intervals throughout the operation of the loom. If desired, the drum 72 may be dispensed with so that the index-yarn storage means is constituted by the supply package 68 alone. In this instance, the index yarn 70 is drawn out directly from the index-yarn supply package 68 to the index-yarn guide and retaining means.

Figure 2:
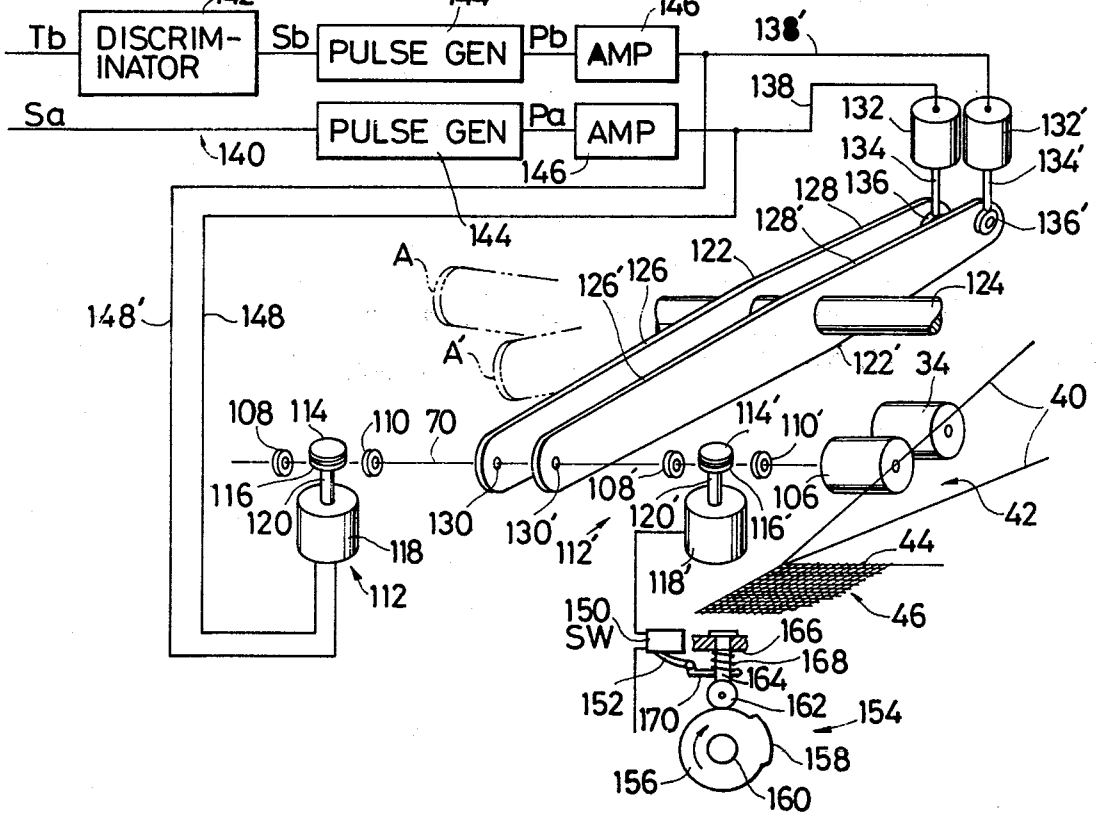
FIG. 2 is a schematic perspective view showing, also partially in a block diagram, a second preferred embodiment of a fabric marking apparatus according to the present invention.

FIG. 2 illustrates another embodiment of the present invention in which the concept of marking a woven fabric with different lengths of index yarn for indicating different natures of discrete events on the fabric as in the embodiment of FIG. 1 is realized in another form. While the features of the embodiment shown in FIG. 2 are, in essence, readily applicable to any type of weaving loom, it is assumed for the purpose of illustration that the embodiment is incorporated into a weaving loom of a fluid-jet type similar to the weaving loom illustrated in FIG. 1. In FIG. 2, only the weft shooting fluid-jet nozzle 34 of such a loom as well as the warp yarns 40 forming the weft filling shed 42 closed at the fell 44 of the woven fabric 46 in the weaving stage of the loom is schematically illustrated. As regards those members, units and means of the weaving loom which are not illustrated in FIG. 2, reference will be made back to FIG. 1 when necessary in the description that follows.

The fabric marking apparatus shown in FIG. 2 comprises index-yarn inserting means which per se is constructed and arranged similarly to the index-yarn inserting means of the embodiment of FIG. 1 and which thus includes an index-yarn shooting fluid-jet nozzle 106 fixedly positioned in parallel with the weft shooting fluid-jet nozzle 34 and in the neighborhood of the fell 44 of the woven fabric 46. Though not shown, the index-yarn inserting means of the embodiment of FIG. 2 further comprises a solenoid-operated valve assembly which has a fluid inlet port communicating with a suitable source of fluid under pressure such as the fluid source for the weft inserting means of the loom and a fluid outlet port which is in communication with the index-yarn shooting fluid-jet nozzle 106. The nozzle 106 has a yarn shooting end located in proximity to one lateral end of the weft filling shed 42 of the warp yarns 40 and directed toward the shed 42 substantially in parallel with the fell 44 of the woven fabric 46 so that the fluid under pressure is ejected from the nozzle 106 into the weft filling shed 42 of the warp yarns 40 when the above mentioned valve assembly is open. As will be described later, the valve assembly for the index-yarn shooting fluid-jet nozzle 106 is actuated to be open during each cycle of operation of the weaving loom, viz., each time the weft shooting fluid-jet nozzle 34 is actuated to eject a jet stream of fluid into the weft filling shed 42. The index-yarn shooting fluid-jet nozzle 106 is supplied with a continuous length of index yarn 70 from suitable index-yarn storage means (not shown) by way of index-yarn guide means and index-yarn retaining means which are located between the index-yarn storage means and the fluid-jet nozzle 106. The index-yarn storage means may be arranged similarly to its counterpart in the embodiment of FIG. 1 and may thus consist of a suitable yarn package such as a cone and a rotatable drum which is adapted to temporarily detain thereon the index yarn drawn from the yarn package either manually or in an automatic fashion.

The above mentioned index-yarn guide means is arranged so that the index yarn 70 which has been hauled from the yarn storage means is enabled to travel substantially straight toward the above mentioned index-yarn shooting fluid-jet nozzle 106 in a predetermined path which is substantially aligned with the direction in which the jet stream of fluid is to be ejected from the fluid-jet nozzle 106. The index-yarn guide means is shown comprising a first pair of yarn-guide eye elements 108 and 110 which are fixedly positioned posterior to the above mentioned index-yarn storage means and a second pair of yarn-guide eye elements 108' and 110' which are fixedly positioned in the vicinity of the index-yarn shooting fluid-jet nozzle 106. All the yarn-guide eye elements 108, 110, 108' and 110' are located substantially in line with the yarn inlet end of the nozzle 106, and the eye elements 108 and 110 or 108' and 110' of each pair are suitably spaced apart from each other in a direction aligned with the yarn inlet and of the nozzle 106. The yarn guide elements are arranged so that the index yarn 70 conveyed from the index-yarn storage means is passed over to the nozzle 106 via the yarn-guide eye elements 108, 110, 108' and 110' in this order.

The index yarn 70 which is passed through the index-yarn guide means thus arranged is allowed to travel through the guide means or retained therebetween by the above mentioned index-yarn retaining means. The index-yarn retaining means of the embodiment herein shown comprises solenoid-operated first and second yarn clamp assemblies 112 and 112' which are provided respectively in association with the above described first and second pairs of yarn-guide eye elements. The first yarn clamp assembly 112 is positioned intermediate between the first pair of yarn-guide eye elements 108 and 110 and, likewise, the second yarn clamp assembly 112' is positioned intermediate between the second pair of yarn-guide eye elements 108' and 110'. The first and second yarn clamp assemblies 112 and 112' are constructed similarly to each other and, thus, corresponding members of the assemblies are designated by like reference numerals with a prime affixed to each of the component members of the second yarn clamp assembly 112'. Each of the first and second yarn clamp assemblies 112 and 112' comprises a stationary clamp member 114 or 114' which is fixedly attached to the frame structure (not shown) of the loom and a movable clamp member 116 or 116' which is movable into and out of the respectively associated stationary clamp member 114 or 114'. Each yarn clamp assembly 112 or 112' further comprises a solenoid unit 118 or 118' having a casing fixedly mounted on the frame structure of the loom and including a core plunger 120 or 120' which is movable with the above mentioned movable clamp member 116 or 116', respectively, and which is coactive with a solenoid coil (not shown) incorporated into the casing of each solenoid unit 118 or 118' for being moved axially inwardly into the casing and thereby causing the movable clamp member 116 or 116' to move away from the respectively associated stationary clamp member 114 or 114' when the solenoid coil is energized from an external power souce (not shown). The core plunger 120 or 120' of each of the solenoid units 118 and 118' is urged to axially protrude outwardly from the casing of the unit and accordingly the movable clamp member 116 or 116' of each clamp assembly is urged to be in contact with the respectively associated stationary clamp member 114 or 114' by suitable biasing means (not shown) which is also incorporated into the casing of each of the solenoid units 118 and 118'. The movable clamp member 116 or 116' of each clamp assembly 108 or 108' is, thus, held in contact with the respectively associated stationary clamp member 114 or 114' when the solenoid coil in the clamp assembly remains de-energized. The yarn-guide eye elements 108 and 110 provided in association with the first yarn clamp assembly 112 are located anterior and posterior, respectively, to the contact area between the clamp members 114 and 116 of the yarn clamp assembly 112 in a direction in which the index yarn 70 is to advance through the contact area and, likewise, the yarn-guide eye elements 108' and 110' provided in association with the second yarn clamp assembly 112' are located anterior and posterior, respectively, to the contact area between the clamp members 114' and 116' of the yarn clamp assembly 112' in a direction of advance of the index yarn 70 through the contact area between the clamp members 114' and 116'. The contact area between the clamp member 114 and 116 of the first yarn clamp assembly 112 and the contact area between the clamp members 114' and 116' of the second yarn clamp assembly 112' as well as the apertures in the individual yarn-guide eye elements 108, 110, 108' and 110' are located substantially in line with the yarn inlet end of the index-yarn shooting fluid-jet nozzle 106 and accordingly with the direction in which a jet stream of fluid is to be ejected from the yarn shooting end of the nozzle 106. Of the yarn-guide eye elements 108, 110, 108' and 110' above described, the eye element 110 posterior to the first yarn clamp assembly 112 and the eye element 108' anterior to the second yarn clamp assembly 112' are spaced apart a predetermined distance from each other intermediate between the first and second yarn clamp assemblies 112 and 112', while the yarn-guide element 110' posterior to the second yarn clamp assembly 112' is located adjacent to the yarn inlet end of the index-yarn shooting fluid-jet nozzle 106. The index yarn 70 extending between the first pair of yarn-guide eye elements 108 and 110 is passed between the stationary and movable clamp members 114 and 116 of the first yarn clamp assembly 112 and, likewise, the index yarn 70 extending between the second pair of yarn-guide eye elements 108' and 110' is passed between the stationary and movable clamp members 114' and 116' of the second yarn clamp assembly 112', as shown. When, thus, the solenoid unit 118 or 118' remains de-energized and as a consequence the movable clamp member 116 or 116' of the clamp assembly is held in contact with the respectively associated stationary clamp member 114 or 114', the index yarn 70 extending between the yarn-guide eye elements 108 and 110 or 108' and 110' is pressed upon between the stationary and movable clamp members 114 and 116 or 114' and 116' of the first or second yarn clamp assembly 112 or 112', respectively, and is retained to the clamp assembly having the solenoid unit 118 or 118' kept deenergized. When the solenoid unit 118 or 118' of the yarn clamp assembly 112 or 112' is being energized and accordingly the movable clamp member 116 or 116' of the assembly is spaced apart from the respectively associated stationary clamp member 114 or 114', the index yarn 70 is allowed to travel through the clamp assembly. The respective solenoid units 118 and 118' of the first and second yarn clamp assemblies 112 and 112' are energized independently of each other so that the index yarn 70 is retained with a predetermined length between the first and second yarn clamp assemblies 112 and 112' or is permitted to travel either through the stationary and movable clamp members 114 and 116 of the first yarn clamp assembly 112 toward the second yarn clamp assembly 112' or through the stationary and movable clamp members 114' and 116' of the second yarn clamp assembly 112' toward the yarn inlet end of the index-yarn shooting fluid-jet nozzle 106, as will be described in detail.

The fabric marking apparatus shown in FIG. 2 further comprises selective index-yarn length-measuring and draw-off means to be actuated by signals with magnitudes which are variable with the natures of the discrete events to be caused in the weaving loom during operation of the loom. The index-yarn length-measuring and draw-off means is adapted to draw the index yarn 70 from the index-yarn storage means to the above described index-yarn guide and retaining means to predetermined lengths which are different depending upon the magnitudes of the signals fed to the length-measuring and draw-off means. The selective index-yarn length-measuring and draw-off means comprises elongated first and second yarn draw-off levers 122 and 122' which are spaced apart substantially in parallel from each other and which have respective intermediate fulcrum portions pivotally mounted on a stationary shaft 124. The shaft 124 is fixedly supported at its opposite axial ends by the frame structure of the loom though not shown in the drawing and extends substantially in parallel with the straight travelling path of the index yarn 70 between the yarn-guide eye elements 110 and 108' located intermediate between the yarn clamp assemblies 112 and 112'. The first and second yarn draw-off levers 122 and 122' are sized and shaped substantially similarly to each other and respectively have, with the shaft 124 positioned at the rear of the travelling path of the index yarn 70 between the above mentioned yarn-guide eye elements 110 and 108', front arm portions 126 and 126' extending from the respective fulcrum portions of the levers forwardly, viz., toward the path of the index yarn 70 between the yarn-guide eye elements 110 and 108' and rear arm portions 128 and 128' extending from the respective fulcrum portions of the levers in the opposite directions to the front arm portions 126 and 126', respectively. The levers 122 and 122' are rotatable independently of each other about the center axis of the stationary shaft 124 through an angular position in which the front arm portion 126 or 126' of each of the levers 122 and 122' extends substantially perpendicularly through and slightly beyond the travelling path of the index yarn 70 between the above mentioned yarn-guide eye elements 110 and 108'. Each of the levers 122 and 122' has formed in the front arm portion 126 or 126' thereof a yarn-passing aperture 130 or 130', respectively, which is located close to the foremost end of the front arm portion so that, when the lever 122 or 122' is in the above mentioned angular position about the center axis of the shaft 124, the yarn-passing aperture 130 or 130' is substantially aligned with the straight travelling path of the index yarn 70 between the yarn-guide eye elements 110 and 108' and accordingly with the respective apertures in the individual yarn-guide eye elements 108, 110, 108' and 110' constituting the index-yarn guide means. The particular angular position of each of the yarn draw-off levers 122 and 122' is herein referred to as the yarn-detaining angular position of the lever about the center axis of the stationary shaft 124. The index yarn 70 extending between the yarn-guide eye elements 110 and 108' is passed through the respective yarn-passing apertures 130 and 130' so that, when both of the first and second yarn draw-off levers 122 and 122' are held in their respective yarn-detaining angular positions, the index yarn 70 is permitted to extend substantially straight on the travelling path of the yarn between the first and second yarn clamp assemblies 112 and 112∝ provided the index yarn 70 is kept taut posterior to the first yarn clamp assembly 112, as indicated by full lines in FIG. 2. When one of the yarn draw-off levers 122 and 122' is rotated out of the yarn-detaining angular position about the center axis of the shaft 124, the yarn-passing aperture 130 or 130' in the lever is moved upwardly above the straight travelling path of the index yarn 70 between the yarn-guide eye elements 110 and 108', pulling the index yarn 70 forwardly of the first yarn clamp assembly 112 and backwardly of the second yarn clamp assembly 112'. If this happens while the solenoid unit 118 of the first yarn clamp assembly 112 is being energized with the solenoid unit 118' of the second yarn clamp assembly 112' kept deenergized so that the index yarn 70 is held anchored to the second yarn clamp assembly 112' but is released from the retaining engagement by the first yarn clamp assembly 112, the index yarn 70 is forwardly hauled through the first yarn clamp assembly 112 by the yarn draw-off lever 122 or 122' which is being turned about the center axis of the shaft 124 away from the yarn-detaining angular position of the lever. The index-yarn 70 is in this manner drawn off from the index-yarn storage means and hauled past the first yarn clamp assembly 112 until the yarn draw-off lever 122 or 122' reaches a predetermined limit angular position about the center axis of the shaft 124 and the solenoid unit 118 of the first yarn clamp assembly 112 is de-energized to have the index yarn 70 retained between the stationary and movable clamp members 114 and 116 of the clamp assembly 112. When the yarn draw-off lever 122 or 122' is turned from the above mentioned limit angular position back to the yarn-detaining angular position thereof the index yarn 70 is allowed to slacken between the first and second yarn clamp assemblies 112 and 112' in the absence of a pull on the index yarn therebetween. The index yarn 70 is detained in the slackened condition between the yarn clamp assemblies 112 and 112' until the solenoid unit 118' of the second yarn clamp assembly 112' is energized and the index yarn 70 thus released from the retaining engagement by the second yarn clamp assembly 112' is driven forward past the first yarn clamp assembly 112. The length to which the index yarn 70 is thus detained between the first and second yarn clamp assemblies 112 and 112' is substantially proportional to the angle between the yarn-detaining angular position and the above mentioned limit angular position of the yarn draw-off lever 112 or 122' about the center axis of the shaft 124.

The selective index-yarn length-measuring and draw-off means further comprises solenoid-operated first and second lever actuating units 132 and 132' which are responsive to the previously mentioned signals and which are adapted to drive the yarn draw-off levers 122 and 122', respectively, to rotate through angles which are dictated by the magnitudes of the signals. The first lever actuating unit 132 is provided in conjunction with the first yarn draw-off lever 122 and includes an elongated movable member or plunger 134 which is pivotally connected at its leading end to the rear arm portion 128 of the lever 122 by a pin 136. Likewise, the second lever actuating unit 132' is provided in conjunction with the second yarn draw-off lever 122' and includes a plunger 134' which is pivotally connected at its leading end to the rear arm portion 128' of the lever 122' by a pin 136'. Though not shown, each of the lever actuating units 132 and 132' further includes a solenoid coil and a magnetic core which is rigidly connected to or integral with the plunger 134 or 134'. Each lever actuating unit 132 or 132' has a casing securely mounted on the frame structure (not shown) of the loom and is positioned in such a manner that the plunger 134 or 134' of each unit is axially movable generally perpendicularly to a plane which passes through the center axis of the shaft 124 and the straight path of the index yarn 70 between the first and second yarn clamp assemblies 112 and 112'. The solenoid coil and the magnetic core of each of the lever actuating units 132 and 132' are arranged so that the plunger 134 or 134' movable with the core is driven to protrude away from the casing of the unit when the solenoid coil is energized from an external power source (not shown). The lever actuating unit 132 or 132' has further incorporated in the casing thereof suitable biasing means (not shown) urging the plunger 134 or 134' to axially retract toward the casing of the unit. When the solenoid coil of each of the lever actuating units 132 and 132' remains deenergized, the plunger 134 or 134' of the unit is held in a fully retracted axial position by the force of the biasing means of the unit and maintains the associated yarn draw-off lever 122 or 122' in the above mentioned yarn-detaining angular position of the lever about the center axis of the shaft 124, as illustrated. When the solenoid coil of each lever actuating unit 132 or 132' is energized, then the plunger 134 or 134' of the unit is caused to protrude out of the above mentioned fully retracted axial position of the plunger and drives the associated yarn draw-off lever 122 or 122' to rotate from the yarn-detaining angular position of the lever through an angle which is substantially proportional to the axial displacement of the plunger thus moved. The respective plungers 134 and 134' of the lever actuating units 132 and 132' axially extend and movable in parallel with each other and the pins 136 and 136' pivotally connecting the plungers 134 and 134' to the yarn draw-off levers 122 and 122' are located at substantially equal distances from the center axis of the shaft 124 supporting the levers 122 and 122'. The first and second lever actuating units 132 and 132' are constructed and arranged in such a manner that the plunger 134 of the first lever actuating unit 132 has a distance of stroke which substantially doubles the distance of stroke of the plunger 134' of the second lever actuating unit 132' when the solenoid coils of the two lever actuating units 132 and 132' are energized with currents having equal magnitudes. When the respective solenoid coils of the first and second lever actuating units 132 and 132' are energized with such currents, therefore, the first yarn draw-off lever 122 is rotated from its yarn-detaining angular position about the center axis of the shaft 124 through an angle which is substantially twice as great as the angle through which the second yarn draw-off lever 122' is rotated from its yarn-detaining angular position about the center axis of the shaft 124. The angle between the yarn-detaining angular position and the previously mentioned limit angular position of the first yarn draw-off lever 122 is, thus, herein assumes to substantially double the angle between the yarn-detaining and limit angular positions of the second yarn draw-off lever 122', the respective limit angular positions of the first and second yarn draw-off levers 122 and 122' being indicated by A and A', respectively, in FIG. 2.

The solenoid coils of the lever actuating units 132 and 132' thus constructed and arranged are jointly connected through lines 138 and 138', respectively, to an electric control circuit 140 which forms part of control means in the embodiment of the fabric marking apparatus illustrated in FIG. 2.

The embodiment of FIG. 2 is also assumed to be operative in response to the weaving rate of the loom and the occurrences of improper picks of the weft yarn in the weaving stage of the loom and thus comprises, in addition to the various means which have been described to form part of the embodiment of FIG. 2, detecting means (not shown) which is per se similar to the detecting means incorporated in the embodiment illustrated in FIG. 1. The detecting means of the embodiment of FIG. 2 is, thus, composed of detectors which are similar to the weaving-rate and improperpick detectors 62 and 64, respectively, of the detecting means provided in the embodiment of FIG. 1 though not shown in FIG. 1 and which accordingly are adapted to produce a train of output signals Sa at intervals each representative of a predetermined unit length of the woven fabric produced in and conveyed forward from the weaving stage of the loom and an output signal Tb indicative of an occurrence of a pick of the weft yarn which is shot from the weft shooting fluid-jet nozzle 34 improperly or unsuccessfully into or throughout the weft-filling shed 42 of the warp yarns 40 during operation of the loom, as discussed in detail with regard to the embodiment illustrated in FIG. 1.

The electric control circuit 140 provided in the embodiment of FIG. 2 is responsive to these signals Sa and Tb produced by the weaving-rate and improper-pick detectors included in the embodiment and comprises an improper-pick discriminating circuit 142 which is similar in effect to its counterpart circuit 96 in the embodiment of FIG 1 and which accordingly is adapted to produce an output signal Sb in response to the signal Tb delivered from the improper pick detector. The control circuit 140 further comprises a first control pulse generator 144 having an input terminal connected to the weaving-rate detector and a second control pulse generator 144' having an input terminal connected to the above mentioned improper-pick discriminating circuit 140. The first control pulse generator 144 is actuated by the signal Sa from the weaving-rate detector to produce an output pulse Pa having a first predetermined duration or pulsewidth, and the second control pulse generator 144' is actuated by the signal Sb from the improper-pick discriminating circuit 142 to produce an output pulse Pb having a second predetermined duration or pulsewidth which is half as long as the first predetermined duration or pulsewidth. The control pulse generators 144 and 144', are so conditioned that each of the pulses delivered therefrom is timed to lapse before the weft yarn is to be shot from the weft shooting fluid-jet nozzle 34 in the weaving cycle which is immediately subsequent to the weaving cycle during which the pulse generator is actuated to produce the particular pulse. Thus, each of the control pulse generators 144 and 144' may be provided with resetting means (not shown) responsive to the timings at which the valve assembly for the weft shooting fluid-jet nozzle 34 is to be actuated to open. The first and second control pulse generators 144 and 144' have output terminals which are connected through first and second amplifiers 146 and 146' to the solenoid coils of the first and second lever actuating units 132 and 132', respectively, and, furthermore, jointly to the coil of the solenoid unit 118 of the first yarn clamp assembly 112 through lines 148 and 148', respectively, as shown. Between the solenoid coil of the yarn clamp assembly 112 and the output terminal of each of the amplifiers 146 and 146' is provided suitable reverse-current preventive means such as diode (not shown) which is adapted to prevent flow of a current from the solenoid coil of the clamp assembly 112 back to each of the amplifiers 146 and 146'. When, thus, the first or second control pulse generator 144 or 144' is actuated, the solenoid coil of the first yarn clamp assembly 112 and the solenoid coil of the first or second lever actuating unit 132 or 132', respectively, are concurrently energized for a period of time which is proportional to the duration or pulsewidth of the output pulse Pa or Pb from the control pulse generator 144 or 144', respectively, with the result that the movable clamp member 116 of the yarn clamp assembly 112 is kept disengaged from the stationary clamp member 114 of the assembly 112 and simultaneously the plunger 134 or 134' of the lever actuating unit 132 or 132' is driven to axially protrude away from the casing of the unit for a period of time which is proportional to either the first predetermined duration or pulsewidth of the output pulse Pa from the first control pulse generator 144 or the second predetermined duration or pulsewidth of the output pulse Pb from the second control pulse generator 144'.

The control means of the embodiment illustrated in FIG. 2 further comprises a switch unit which is connected between the coil of the solenoid unit 118' of the second yarn clamp assembly 112' and a power source (not shown) and which is responsive to the timings at which the weft yarn is to be shot into the weft-filling shed 42 of the warp yarns 40 throughout operation of the loom. The switch unit is herein assumed to be constituted by a microswitch 150 having a spring-loaded actuating element 152 which is biased to hold the microswitch 150 open. The microswitch 150 is closed in cycles synchronized with the weaving cycles of the loom under the control of an intermittent-motion drive mechanism 154 which also dictates the cycles in which the weft yarn is to be inserted into the weft-filling shed 42 of the warp yarns 40. The intermittent-motion drive mechanism 154 comprises a cam 156 having a protruded cam lobe portion 158 and securely mounted on a camshaft 160. Though not shown in the drawing, the camshaft 160 is operatively connected to a main drive unit of the weaving loom through a suitable transmission mechanism such as for example a gear assembly and is adapted to be driven at a speed which is synchronized with the speeds at which other rotatable or otherwise movable members and structures of the loom are to be driven. The cam 156 is assumed to be driven in such a manner as to make a full turn about the axis of the camshaft 160 per weaving cycle of the loom. A cam follower roller 162 is in rollable contact with the cam 156 and is rotatably mounted on a guide rod 164 which is axially movable through a stationary support member 166 secured to or integral with the frame structure of the loom. The cam follower roller 162 is forced against the cam 156 by a helical compression spring 168 which is anchored at one end to the guide rod 164 and seated at the other end on the support member 166. The guide rod 164 has secured thereto a pressing element 170 which is engageable with the actuating element 152 of the microswitch 150. When the cam 156 being driven to rotate about the axis of the camshaft 160 assumes an angular position having the cam follower roller 162 in rolling contact with the lower cam surface portion of the cam 156 as shown, the guide rod 164 and accordingly the pressing element 170 are held in positions to allow the actuating element 152 of the microswitch 150 to stay in a position holding the microswitch 150 open by the force of the spring (not shown) acting on the actuating element 152. As the cam 156 is turned about the axis of the camshaft 160 and assumes an angular position having the cam follower roller 162 received on the protruded cam lobe portion 158 of the cam 156, then the guide rod 164 and the pressing element 170 are raised away from the axis of the camshaft 160, the pressing element 170 is brought into pressing engagement with the actuating element 152 of the microswitch 150 and causes the microswitch to close against the force of the spring acting on the actuating element 152. The microswitch 150 is thus maintained closed while the cam follower roller 162 is held in rolling contact with the protruded cam lobe portion 158 of the cam 156. The central angle of the protruded cam lobe portion 158 of the cam 156 is determined to correspond to the period of time required for each weft inserting cycle of the loom so that the microswitch 150 is kept closed for each period of time for which the weft yarn is being inserted into the weft-filling shed 42 of the warp yarns 40. More specifically, the microswitch 150 is closed at an instant when the valve assembly for the weft shooting fluid-jet nozzle 34 is to be opened up at an incipient stage of each weaving cycle of the loom, and is made open before the reed 48 (FIG. 1) is to be initiated into motion to beat up the pick of the weft yarn inserted into the weft-filling shed 42 at a late stage of each weaving cycle of the loom. The weaving loom is thus provided with means adapted to transmit the motion of the cam follower roller 162 or the guide rod 164 to any actuating means of the valve assembly for the weft shooting fluid-jet nozzle 34. In the embodiment herein shown, the microswitch 150 is assumed to be electrically connected not only to the solenoid unit 118' of the second yarn clamp assembly 112' as above described but to the previously mentioned solenoid-operated valve assembly for the index-yarn shooting fluid-jet nozzle 106 so that the valve assembly is actuated to open simultaneously when the solenoid unit 118' of the clamp assembly 112' is energized. If, furthermore, the valve assembly for the weft shooting fluid-jet nozzle 34 is of a solenoid-operated type, the microswitch 146 may also be electrically connected to the solenoid coil of such a valve assembly.

Throughout operation of the loom, the cam 156 of the above described intermittent-motion drive mechanism is kept driven to rotate at a constant speed about the axis of the camshaft 160 and has its protruded cam lobe portions 158 brought into contact with the cam follower roller 162 in cycles synchronized with the weaving cycles of operation of the loom. During each weaving cycle of the loom, therefore, the microswitch 150 is closed for a predetermined period of time corresponding to the central angle of the protruded cam lobe portion 158 of the cam 156, causing the coil of the solenoid unit 118' of the second yarn clamp assembly 112' and the solenoid coil of the valve assembly for the index-yarn shooting fluid-jet nozzle 106 to be energized from a power source (not shown). The core plunger 120' of the solenoid unit 118' is therefore caused to retract inwardly of the casing of the solenoid unit and causes the movable clamp member 116' of the assembly 112' to move away from the stationary clamp member 114', allowing the index yarn 70 to move through the second yarn clamp assembly 112' provided the yarn is in a condition slackened between the first and second yarn clamp assemblies 112 and 112'. Simultaneously when the second yarn clamp assembly 112' is thus rendered into the condition allowing the index yarn 70 to pass therethrough, the solenoid-operated valve assembly for the index-yarn shooting fluid-jet nozzle 106 is actuated to open up and enables the nozzle 106 to eject fluid under pressure into the weft-filling shed 42 of the warp yarns 40 concurrently with the weft-shooting fluid-jet nozzle 34 which is also actuated to eject fluid under pressure into the shed 42 with the cam follower roller 162 brought into the rolling contact with the protruded cam lobe portion 158 of the cam 156. If, under these conditions, the index yarn 70 is allowed to travel through the second yarn clamp assembly 112' as above discussed, the index yarn is entrained on the jet stream of the fluid ejected from the nozzle 106 and is shot along with the pick of the weft yarn shot from the weft shooting fluid-jet nozzle 34 into the weft-filling shed 42 of the warp yarns 40. The second yarn clamp assembly 112' and the valve assembly for the index-yarn shooting fluid-jet nozzle 106 are maintained operative in the above described conditions for the period of time for which the cam follower roller 162 is riding on the protruded cam lobe portion 158 of the cam 156. As the cam 156 is further turned about the axis of the camshaft 160 and has its protruded cam lobe portion 158 moved past the cam follower roller 162, the microswitch 150 is made open and causes the respective solenoid coils of the second yarn clamp assembly 112' and the valve assembly for the index-yarn shooting fluid-jet nozzle 106 to be de-energized. Accordingly, the movable clamp member 116' of the yarn clamp assembly 112' is moved back into contact with the stationary clamp member 114' with the index yarn 70 closely clamped therebetween and at the same time the valve assembly for the nozzle 106 is allowed to close with the microswitch 150 made open. Simultaneously when the index yarn shooting fluid-jet nozzle 106 thus ceases ejection of fluid therefrom, the weft shooting fluid-jet nozzle 34 is also caused to terminate its operation to shoot the pick of the weft yarn into the weft-filling shed 42 of the warp yarns and puts an end to the weft shooting cycle which has been in progress.

Upon termination of the weft shooting cycle in which the index yarn 70 has been inserted into the weft filling shed 42 of the warp yarns 40, the index yarn is stretched tautly between the first and second yarn clamp assemblies 112 and 112' both of which are held in condition having their respective movable clamp members 116 and 116' in contact with the stationary clamp members 114 and 114'. If the index yarn 70 is maintained taut between the first and second yarn clamp assemblies 112 and 112' for the remaining period of time of the weaving cycle, the index yarn is kept anchored to the first yarn clamp assembly 112 and is not allowed to travel forwardly through the second yarn clamp assembly 112' when the microswitch 150 is closed and as a consequence the respective solenoid coils of the second yarn clamp assembly 112' and the valve assembly for the index-yarn shooting fluid-jet nozzle 106 are energized during the subsequent weft shooting cycle of the loom. Only the weft yarn is inserted into the weft-filling shed 42 of the warp yarns 40 during a weaving cycle in which the index yarn 70 is kept taut between the first and second yarn clamp assemblies 112 and 112' at an early stage of the weaving cycle.

As the picks of the weft yarn are inserted into the weft-filling shed 42 of the warp yarns 40 and the woven fabric 46 is produced in and stepwise conveyed away from the weaving stage of the loom, pulses Sa are supplied to the control circuit 140 at time intervals each of which corresponds to the predetermined unit length of the fabric produced. Each of the signals Sa is produced and fed to the first control pulse generator 144 of the control circuit 140 upon completion of the weft shooting operation in a weaving cycle in which a pick of the weft yarn is woven into the fabric at the end of each predetermined unit length of the woven fabric. In response to each signal Sa, the first control pulse generator 144 produces an output pulse Pa having the previously mentioned first predetermined duration or pulse-width. The output pulse Pa of the control pulse generator 144 is fed, upon amplification by the first amplifier 146, to the coil of the solenoid unit 118 of the first yarn clamp assembly 112 through the line 148 and further to the solenoid coil of the first lever actuating unit 132 of the selective index-yarn length-measuring and draw-off means through the line 138. The solenoid unit 118 of the first yarn clamp assembly 112 being thus energized with the pulse Pa, the movable clamp member 116 of the yarn clamp assembly 112 is moved away from the stationary clamp member 114 of the assembly 112 and renders the index yarn 70 operable to travel forwardly through the open area between the clamp members 114 and 116 of the clamp assembly 112. On the other hand, the pulse Pa supplied to the solenoid coil of the first lever actuating unit 132 through the line 138 causes the plunger 134 of the lever actuating unit 132 to protrude from its fully retracted axial position so that the first yarn draw-off lever 122 is driven to turn from its yarn-detaining angular position about the center axis of the shaft 124. As the first yarn draw-off lever 122 is thus turned on the shaft 124, the yarn-passing aperture 130 in the first arm portion 126 of the lever 122 is moved upwardly in an arc above the straight travelling path of the index yarn 70 between the first and second yarn clamp assemblies 112 and 112' with the result that the index yarn 70 which is engaged by the lever 122 through the yarn-passing aperture 130 is urged upwardly between the yarn-passing aperture 130' in the second yarn draw-off lever 122' held in the yarn-detaining angular position thereof and the yarn guide eye element 110 posterior to the first yarn clamp assembly 112. The first yarn clamp assembly 112 being in a condition having the index yarn 70 released from the retaining engagement between the clamp members 114 and 116 of the assembly 112 as above stated and the second yarn clamp assembly 112' being held in a condition having the index yarn 70 retained between the stationary and movable clamp members 114' and 116' of the assembly 112' having its solenoid unit 118' kept de-energized, the index yarn 70 being urged upwardly between the above mentioned yarn guide eye element 110 and the yarn-passing aperture 130' in the second yarn draw-off lever 122' by means of the first yarn draw-off lever 122 is caused to travel forwardly through the open area between the clamp members 114 and 116 of the first yarn clamp assembly 112 as the lever 122 is turned about the center axis of the shaft 124. When the plunger 134 of the first lever actuating unit 132 is protruded the predetermined distance of stroke from the initial, fully retracted axial position of the plunger, the first yarn draw-off lever 122 reaches the previously mentioned limit angular position thereof as indicated by A in FIG. 2. The first yarn clamp assembly 112 is held in the condition allowing the index yarn 70 to travel forwardly therethrough for a period of time which is substantially equal to the duration of the pulse Pa which is delivered to the solenoid unit 118 of the clamp assembly 112. The first lever draw-off lever 122 reaches the limit angular position thereof before the pulse Pa fed to the solenoid coil of the first lever actuating unit 132 lapses. During the period of time when the first lever actuating unit 132 is being energized with the pulse Pa, the index yarn 70 is allowed to travel forwardly through the first yarn clamp assembly 112 by a length which varies with the angle through which the first yarn draw-off lever 122 is turned from its yarn-detaining angular position about the center axis of the shaft 124. By the point of time at which the pulse Pa fed to the solenoid coil of the first lever actuating unit 132 lapses, therefore, the index yarn 70 is passed through the first yarn clamp assembly 112 by a length which corresponds to the angle of rotation of the first yarn draw-off lever 122 between the yarn-detaining and limit angular positions thereof. When the pulse Pa then lapses, the solenoid unit 118 of the first yarn clamp assembly 112 is deenergized and as a consequence the movable clamp member 116 of the clamp assembly 112 is moved back into contact with the stationary clamp member 114 of the assembly and for a second time causes the index yarn 70 to be anchored to the first yarn clamp assembly 112. Upon lapse of the pulse Pa, the solenoid coil of the first lever actuating unit 132 is also de-energized and allows the plunger 134 to retract into the initial axial position thereof, causing the first yarn draw-off lever 122 to turn backwardly from the limit angular position A to the initial yarn-detaining angular position of the lever about the center axis of the shaft 124. When the first yarn draw-off lever 122 thus resumes the yarn-detaining angular position thereof, the index-yarn 70 is slackened between the first and second yarn clamp assemblies 112 and 112' and is ready to be hauled forwardly away from the first yarn clamp assembly 112.

When the microswitch 150 is closed at an incipient stage of the subsequent weaving cycle of the operation to start the weft shooting operation in the cycle, both the solenoid unit 118' of the second yarn clamp assembly 112' and the valve assembly for the index-yarn shooting fluid-jet nozzle 106 are energized through the microswitch 150 with the result that the second yarn clamp assembly 112' is brought into the condition allowing the index yarn 70 to pass therethrough and at the same time the valve assembly for the nozzle 106 is opened up to permit the nozzle 106 to eject fluid under pressure therefrom. The index yarn 70 which has been maintained in a slackened condition between the first and second yarn clamp assemblies 112 and 112' is therefore urged forwardly by the force of the jet stream of the fluid spurting from the nozzle 106 and is forced to travel through the open area between the stationary and movable clamp members 114' and 116' of the second yarn clamp assembly 112' and through the nozzle 106 into the weft-filling shed 42 of the warp yarns 40 concurrently with the pick of the weft yarn which is shot from the weft shooting fluid-jet nozzle 34 into the shed 42. The index yarn 70 thus shot from the index-yarn shooting fluid-jet nozzle 106 is admitted into the weft-filling shed 42 of the warp yarns 40 until the index yarn 70 becomes taut from the first yarn clamp assembly 112 forward. When the insertion of the weft yarn into the weft-filling shed 42 is thereafter completed, the microswitch 150 is made open by the intermittent-motion drive mechanism 154 and index-yarn shooting nozzle 106 to cease ejection of fluid therefrom and the second yarn clamp assembly 112' to resume its initial condition having the index yarn 70 retained between the stationary and movable clamp members 114' and 116' of the assembly 112'. The picks of the weft and index yarns are then beaten up by the reed against the fill 44 of the woven fabric 46 and are thereafter cut off from the remainders of the respective yarns leading from the nozzles 34 and 106. The woven fabric 46 is now interwoven with a cut segment of the index yarn 70 as an indicium of the predetermined unit length of the fabric 46 which has been produced in and conveyed from the weaving stage of the loom. The length of the cut segment of the index yarn 70 thus incorporated into the woven fabric 46 is a function of the turning angle of the first yarn draw-off lever 122 between the yarn-detaining angular position and the limit angular position A of the lever and is, accordingly, dictated by the duration or pulse-width of the output pulse Pa from the first control pulse generator 144.

In the event it happens that a pick of the weft yarn has failed to be properly shot into the weft-filling shed 42 of the warp yarns in any of the weaving cycles of the loom, the improper-pick discriminating circuit 142 is supplied with a signal Tb and delivers an output signal Sb to the second control pulse generator 144'. In response to the signal Sb thus fed from the discriminating circuit 142, the second control pulse generator 144' is actuated to deliver an output pulse Pb having the previously mentioned second predetermined duration or pulsewidth. The output pulse Pb of the control pulse generator 144' is passed through the second amplifier 146' to the solenoid unit 118 of the first yarn clamp assembly 112 through the line 148' and to the solenoid coil of the second lever actuating unit 132' through the line 138'. With the pulse Pb fed to the solenoid unit 118 of the first yarn clamp assembly 112, the index yarn 70 is released from the retaining engagement by the clamp assembly and is rendered operable to travel forwardly through the clamp assembly 112. On the other hand, the pulse Pb supplied to the solenoid coil of the second lever actuating unit 132' through the line 138' causes the plunger 134' of the lever actuating unit 132' to protrude from its fully retracted axial position with the result that the second yarn draw-off lever 122' is driven to turn from its yarn-detaining angular position about the center axis of the shaft 124 and as a consequence the yarn-passing aperture 130' in the first arm portion 126' of the lever 122' is moved upwardly in an arc above the travelling path of the index yarn 70 between the yarn-passing aperture 130 in the first yarn draw-off lever 122 held in the yarn-detaining angular position thereof and the yarn-guide eye element 108' anterior to the second yarn clamp assembly 112'. The index yarn 70 is thus urged upwardly between the above mentioned yarn-guide eye element 108' and the yarn-passing aperture 130 in the first yarn draw-off lever 122 and is caused to travel forwardly through the open area between the clamp members 114 and 116 of the first yarn clamp assembly 112 having its solenoid unit 118 being energized. When the plunger 134' of the second lever actuating unit 132' is protruded the predetermined distance of stroke from its initial, fully retracted axial position, the second yarn draw-off lever 122' reaches the limit angular position of the lever 122' as indicated by A' in FIG. 2. The first yarn clamp assembly 112 is maintained in the condition allowing the index yarn 70 to travel forwardly therethrough for a period of time which is substantially equal to the duration of the pulse Pb which is delivered to the solenoid unit 118 of the clamp assembly 112. The second yarn draw-off lever 122' reaches the limit angular position thereof before the pulse Pb fed to the solenoid coil of the second lever actuating unit 132' lapses. During the period of time when the second lever actuating unit 132 is being energized with the pulse Pb, the index yarn 70 is allowed to travel forwardly through the first yarn clamp assembly 112 by a length which is dictated by the angle through which the second yarn draw-off lever 122' is turned from its yarn-detaining angular position about the center axis of the shaft 124. By the point of time at which the pulse Pb fed to the solenoid coil of the second lever actuating unit 132' lapses, the index yarn 70 is thus passed through the first yarn clamp assembly 112 by a length which corresponds to the turning angle of the second yarn draw-off lever 122' between the yarn-detaining and limit angular positions thereof. When the pulse Pb then lapses, the solenoid unit 118 of the first yarn clamp assembly 112 is de-energized to render the clamp assembly operative to retain the index yarn 70 thereto and at the same time the solenoid coil of the second yarn draw-off unit 132' is also de-energized to allow the plunger 134' of the unit to retract into the initial axial position thereof, thereby causing the second yarn draw-off lever 122' to turn backwardly from the limit angular position A' to the yarn-detaining angular position thereof about the center axis of the shaft 124. When the second yarn draw-off lever 122' thus resumes the yarn-detaining angular position thereof, the index yarn 70 is slackened between the first and second yarn clamp assemblies 112 and 112' and is ready to be hauled forwardly away from the first yarn clamp assembly 112.

When the microswitch 150 is closed so that the second yarn clamp assembly 112' is brought into the condition having the index yarn 70 released from the clamping engagement of the assembly and the index-yarn shooting fluid-jet nozzle 106 is made operative to eject fluid therefrom, the index yarn 70 is forced to travel forwardly through the open area between the clamp members 114' and 116' of the second yarn clamp assembly 112' and through the nozzle 106 into the weft-filling shed 42 of the warp yarns 40 concurrently with the pick of the weft yarn which is shot from the weft shooting fluid-jet nozzle 34 as previously described. The fabric 46 produced in the weaving stage of the loom is in these manners interwoven with a cut segment of the index yarn 70 as an indicium of the occurrence of an improper pick of the weft yarn in the immediately preceding weaving cycle of the loom. The cut segment of the index yarn 70 thus incorporated into the woven fabric 46 has a length which is a function of the turning angle of the second yarn draw-off lever 122' between the yarn-detaining angular position and the limit angular position A' of the lever 112' and which is accordingly dictated by the duration of the pulse Pb delivered from the second control pulse generator 144'. The duration or pulsewidth of the output pulse Pb from the second control pulse generator 144' being assumed to be half as long as the duration or pulsewidth of the output pulse Pa from the first control pulse generator 144 as previously noted, the cut segment of the index yarn 70 inserted into the woven fabric 46 in response to the output pulse Pb is shorter in length than the cut segment of the index yarn inserted into the fabric 46 in response to the output pulse Pa so that the end of each predetermined unit length of the fabric woven and an occurrence, if any, of a weft yarn improperly inserted into the fabric can be distinguished from each other by the lengths of the inserts of the index yarn in the fabric completed. As in the embodiment of FIG. 1, it is preferable that the index yarn 70 for use in the arrangement hereinbefore described be of a color which is different from or clearly contrasting to the colors of the weft yarn or yarns to be put to use or the colors of the warp and weft yarns to form the fabric. The respective lengths of these inserts serving as indicia of the unit length of the fabric produced and the occurrences of the improperly picked weft yarns are dictated by the turning angles of the first and second yarn draw-off levers 122 and 122' between the respective yarn-detaining angular positions and the respective limit angular positions A and A' of the levers about the center axis of the shaft. In the embodiment of FIG. 2, the respective turning angles of the first and second yarn draw-off levers 122 and 122' are, in turn, dictated by the predetermined distances of stroke of the plungers 134 and 134' of the first and second lever actuating units 132 and 132' with the plungers 134 and 134' pivotally connected to the levers 122 and 122' at points which are located at substantially equal distances from the center axis of the shaft 124. If, desired, however, the respective pivotal points at which the plungers 134 and 134' of the first and second lever actuating units 132 and 132' are connected to the first and second yarn draw-off levers 122 and 122' may be located from the center axis of the shaft 124, viz., the respective fulcrum points of the levers 122 and 122' at distances which differ from each other in such a ratio that the first and second yarn draw-off levers 122 and 122' are turned about the center axis of the shaft 124 through angles differing in the particular ratio when the plungers 134 and 134' of the lever actuating units 132 and 132' are moved equal distances. If, for example, the first and second lever actuating units 132 and 132' are arranged so that the respective plungers 134 and 134' thereof have substantially equal distances of stroke and are pivotally connected to the first and second yarn draw-off levers 122 and 122', respectively, at points which are located at distances in the ratio of 1 to 2 from the center axis of the shaft 124, then the first and second yarn draw-off levers 122 and 122' are turned about the axis of the shaft 124 through angles which are in the ratio of 2 to 1, respectively, for the levers 122 and 122' when the first and second lever actuating units 132 and 132' are actuated. The solenoid-operated valve assembly for the index-yarn shooting nozzle 106 as well as the solenoid unit 118' of the second yarn clamp assembly 112' has been assumed to be connected to and controlled by the microswitch 150, but the valve assembly and the solenoid unit 118' may be electrically connected through suitable delay or memory means to the lines 148 and 148' leading from the control circuit 140 so that the index-yarn shooting nozzle 106 and the second yarn clamp assembly 118' are actuated solely in cycles which are subsequent to the cycles in which an output pulse Pa or Pb is delivered from the control pulse generator 144 or 144' as in the embodiment of FIG. 1.

Figure 3:
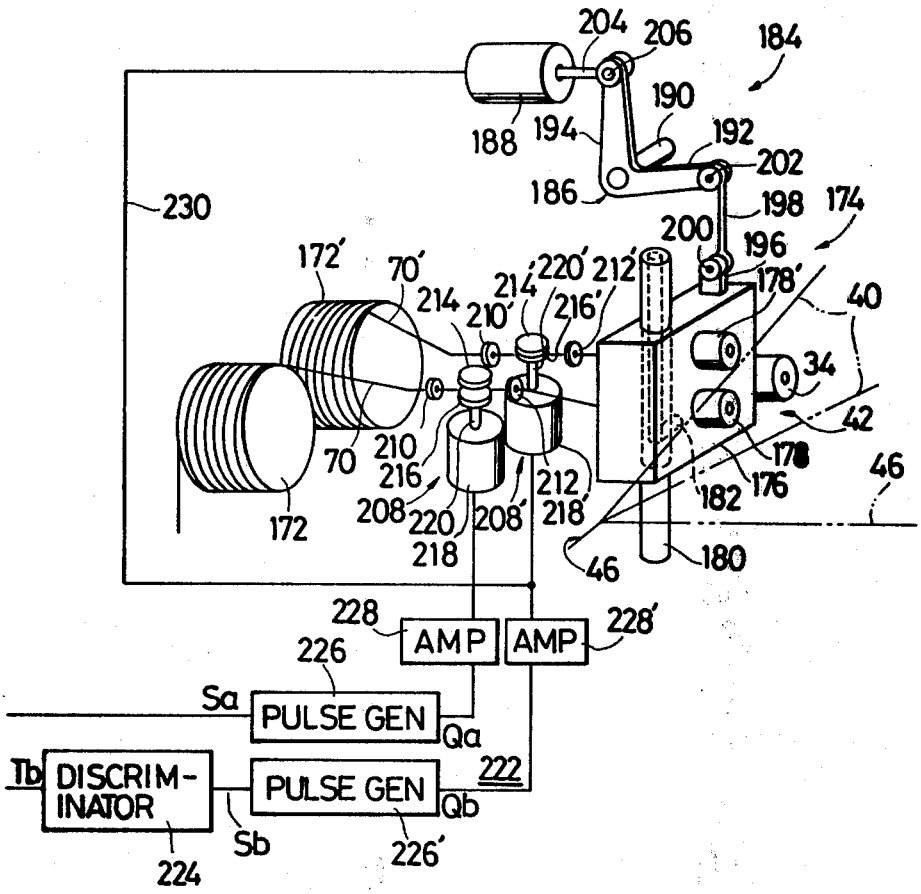
FIG. 3 is a schematic perspective view showing, also partially in a block diagram, a third preferred embodiment of a fabric marking apparatus according to the present invention.

While only one continuous length of index yarn is used for the indication of discrete events of different natures in each of the embodiments hereinbefore described with reference to FIGS. 1 and 2, two or more different continuous lengths of index yarns may be utilized respectively for different natures of discrete events to occur in a woven fabric. FIG. 3 illustrates an embodiment of a fabric marking apparatus which is adapted to indicate occurrences of discrete events of two different natures by the use of two continuous lengths of index yarns which are different in colors and which are respectively allocated to the two different natures of the discrete events to be indicated in a woven fabric.

Referring to FIG. 3, the embodiment shown uses first and second index yarns 70 and 70' of different colors and comprises index-yarn storage means including first and second rotatable drums 172 and 172' having respective axes of rotation which are arranged substantially in parallel with each other. The first and second index yarns 70 and 70' are wound each by a suitable number of turns, around these rotatable drums 172 and 172', respectively, and are fed from suitable yarn supply packages (not shown) which are provided respectively in conjunction with the drums 172 and 172'. Each of the rotatable drums 172 and 172' are arranged in such a manner that the drum is free to turn about the axis of rotation thereof and thus allows the index yarn 70 or 70' to be freely unwound and hauled therefrom when the index yarn is tensioned or pulled forwardly away from the drum. The index yarns 70 and 70' leading from the first and second rotatable drums 172 and 172' are passed by way of index-yarn guide and retaining means jointly to index-yarn inserting means 174.

The weaving loom incorporating the embodiment of FIG. 3 is also assumed to be of a fluid-jet type and, thus, includes a weft inserting fluid-jet nozzle 34 which is directed toward the weft-filling shed 42 of warp yarns 40 which are to form a woven fabric 46 having a fell 46 at the foremost end of the shed 42. The above mentioned index-yarn inserting means 174 is positioned in the vicinity of this weft shooting fluid-jet nozzle 34 and comprises a nozzle carrier 176 which is in its entirety vertically movable in proximity to one lateral end of the weft-filling shed 42 of the warp yarns 40. The nozzle carrier 176 has mounted thereon first and second or lower and upper index-yarn shooting fluid-jet nozzles 178 and 178' which are directed toward the weft-filling shed 42 of the warp yarns 40 substantially in parallel with the fell 44 of the woven fabric 46. The carrier 176 is movable between a first or upper position having the first or lower index-yarn shooting fluid-jet nozzle 178 aligned with the warp line within the weft-filling shed 42 and a second or lower position having the second or upper index-yarn shooting fluid-jet nozzle 178' aligned with the warp line. As previously noted with reference to FIG. 1, the warp line within the weft-filling shed 42 of the warp yarns 40 is located on a horizontal center plane between the angularly spaced two webs of the warp lines meeting at the fell 44 of the woven fabric 46 and extends throughout the width of the weft-filling shed 42. A stationary fluid-feed pipe 180 vertically extends through the nozzle carrier 176 and has a fluid-discharge fitting 182 which is located so that communication is provided between the fluid-discharge fitting 182 and the lower or upper index-yarn shooting fluid-jet nozzle 178 or 178' when the nozzle carrier 176 is moved into the upper or lower position, respectively, thereof. The fluid-feed pipe 180 is in communication with a suitable source (not shown) of fluid under pressure so that the pressurized fluid is passed through the fluid-feed pipe 180 and the fluid-discharge fitting 182 to the lower or upper index-yarn shooting fluid-jet nozzle 178 or 178' when the nozzle carrier 176 is in the upper or lower position, respectively, thereof.

The embodiment of the fabric marking apparatus illustrated in FIG. 3 further comprises carrier drive means 184 for moving the nozzle carrier 176 selectively into either of the above mentioned first and second or upper and lower positions in accordance with signals which are supplied to the drive means. Such carrier drive means is shown comprising a bell-crank lever 186 and a solenoid-operated lever actuating unit 188. The bell-crank lever 186 has an intermediate fulcrum portion rotatably mounted on a horizontal stationary shaft 190 which is secured to the fame structure (not shown) of the loom. The bell-crank lever 186 further has two arm portions 192 and 194 which are angularly spaced apart from each other above the above mentioned intermediate fulcrum portion of the lever. The nozzle carrier 176 has fixedly fitted thereto a suitable bracket 196 and a connecting rod 198 is pivotally connected at one end to this bracket 196 by a pin 100 and at the other end to one arm portion 192 of the bell-crank lever 186 by a pin 202. On the otherhand, the solenoid-operated lever actuating unit 188 comprises an elongated movable member or plunger 204 which is pivotally connected at its leading end to the other arm portion 194 of the bell-crank lever 186 by a pin 206. Though not shown, the lever actuating unit 188 further comprises a solenoid coil, a magnetic core which is rigidly connected to or integral with the plunger 204, and a casing securely mounted on the frame structure of the loom, the solenoid coil and the magnetic core being arranged so that the plunger 204 movable with the magnetic core is driven to protrude away from the casing of the unit when the solenoid coil is energized from an external power source (not shown). The lever actuating unit 188 has further incorporated into the casing thereof suitable biasing means (not shown) urging the plunger 204 to axially retract toward the casing of the unit 188. When the solenoid coil of the leve actuating unit 188 thus constructed and arranged remains de-energized, the plunger 204 of the unit 188 is held in a fully retracted axial position by the force of the biasing means of the unit and maintains the bell-crank lever 186 in a first angular position about the center axis of the shaft 190, holding the nozzle carrier 176 in the first or upper position thereof as illustrated in the drawing. Under these conditions, the fluid-discharge fitting 182 on the fluid-feed pipe 180 is in communication with the first index-yarn shooting fluid-jet nozzle 178 on the nozzle carrier 176 as shown. When the solenoid coil of the lever actuating unit 188 is energized, then the plunger 202 of the unit 188 is caused to protrude out of the above mentioned fully retracted axial position of the plunger and drives the bell-crank lever 186 to turn from the first angular position of the lever 186 to a second angular position about the center axis of the shaft 190, moving the nozzle carrier 176 from the first or upper position to the second or lower position thereof.

The previously mentioned index-yarn guide and retaining means of the fabric marking apparatus illustrated in FIG. 3 comprises solenoid-operated, first and second yarn clamp assemblies 208 and 208', a first pair of yarn-guide eye elements 210 and 212, and a second pair of yarn-guide eye elements 210' and 212'. Each of the first and second yarn clamp assemblies 208 and 208' is constructed similarly to the yarn clamp assemblies 112 and 112' in the embodiment of FIG. 2 and thus comprises a stationary yarn clamp member 214 or 214' fast on the frame structure (not shown) of the loom, a movable yarn clamp member 216 or 216' movable into and out of contact with the stationary yarn clamp member 214 or 214', respectively, and a solenoid unit 218 or 218' having a casing fixedly mounted on the frame structure of the loom and including a core plunger 220 or 220' which is movable with the above mentioned movable yarn clamp member 216 or 216', respectively, and a solenoid coil (not shown) incorporated into the casing of each solenoid unit 218 or 218' so that the core plunger 220 or 220' is axially moved into the casing of the unit and causes the movable yarn clamp member 216 or 216' to move away from the respectively associated stationary yarn clamp member 214 or 214' when the solenoid coil is energized from an external power source (not shown). The core plunger 220 or 220' of the solenoid unit 218 or 218' of each of the yarn clamp assembly 208 or 208' is urged to axially protrude outwardly from the casing of the solenoid unit and accordingly the movable clamp member 216 or 216' of each clamp assembly is urged to be in contact with the respectively associated stationary clamp member 214 or 214' by suitable biasing means (not shown) which is also incorporated into the casing of each of the solenoid units 218 and 218'. The movable clamp member 216 or 216' of each yarn clamp assembly 208 or 208' is, thus, held in contact with the respectively associated stationary clamp member 214 or 214' when the solenoid coil in the clamp assembly remains de-energized. The previously mentioned yarn-guide eye elements 210 and 212 are provided in association with the first yarn clamp assembly 208 and are fixedly positioned anterior and posterior, respectively, to the contact area between the stationary and movable clamp members 214 and 216 of the clamp assembly 208 in a direction in which the first index yarn 70 leading from the first rotatable drum 172 of the index-yarn storage means is to forwardly advance toward the nozzle carrier 176 of the index-yarn shooting means. Likewise, the previously mentioned yarn-guide eye elements 210' and 212' are provided in association with the second yarn clamp assembly 208' and are fixedly positioned anterior and posterior, respectively, to the contact area between the stationary and movable clamp members 214' and 216' of the second yarn clamp assembly 208' in a direction in which the second index yarn 70' leading from the second rotatable drum 172' of the index-yarn storage means is to forwardly advance toward the nozzle carrier 176. The yarn-guide elements 212 and 212' posterior to the first and second yarn clamp assemblies 208 and 208', respectively, are located in the vicinity of that vertical position of each of the first and second index-yarn shooting fluid-jet nozzles 178 and 178' on the nozzle carrier 176 which is aligned with the previously mentioned warp line within the weft-filling shed 42 of the warp yarns 40. The first index yarn 70 leading from the first rotatable drum 172 is passed through the yarn-guide eye element 210, the contact area between the stationary and movable clamp members 214 and 216 of the first yarn clamp assembly and the yarn-guide eye element 212 to the first index-yarn shooting fluid-jet nozzle 178 on the nozzle carrier 176 and, likewise, the second index yarn 70' leading from the second rotatable drum 172' is passed through the yarn-guide eye element 210', the contact area between the stationary and movable clamp members 214' and 216' of the second yarn clamp assembly 208' and the yarn-guide eye element 212' to the second index-yarn shooting fluid-jet nozzle 178' on the nozzle carrier 176.

The respective solenoid units 218 and 218' of the first and second yarn clamp assemblies 208 and 208' and the solenoid-operated lever actuating unit 188 are energized and de-energized under the control of an electric control circuit 222 which constitutes control means of the embodiment of the fabric marking apparatus illustrated in FIG. 3. As in the embodiments of FIGS. 1 and 2, the electric control circuit 222 is assumed to be responsive to a predetermined unit length of the fabric 44 woven in the weaving stage of the loom and to picks of the weft yarn improperly interwoven into the fabric and is, thus, shown composed of an improper-pick discriminating circuit 224, first and second control pulse generators 226 and 226' and first and second amplifier 228 and 228'. The improper-pick discriminating circuit 224 is supplied with a signal Tb representative of an occurrence of a pick of the weft yarn improperly shot into the weaving shed 42 of the warp yarns and delivers an output signal Sb to the second control pulse generator 226' in response to the signal Tb thus impressed on the input terminal thereof. The first control pulse generator 226' is supplied with a signal Sa representative of the predetermined unit length of the fabric 46 woven in and stepwise conveyed away from the weaving stage of the loom during operation of the loom. In response to the signals Sa and Sb thus applied to the respective input terminals of the first and second control pulse generators 226 and 226', the control pulse generators 226 and 226' produce output pulses Qa and Qb, respectively, which have any predetermined durations or pulse-widths. By way of example, the respective durations or pulsewidths of the output pulses Qa and Qb to be delivered from the first and second control pulse generators 226 and 226' are herein assumed to be substantially equal to each other. The control pulses Qa and Qb are fed through the first and second amplifiers 228 and 228' to the coils of the solenoid units 218 and 218' of the first and second yarn clamp assemblies 208 and 208', respectively. The pulse Pb delivered from the second control pulse generator 226 is also fed, upon amplification by the second amplifier 228, to the solenoid coil of the lever actuating unit 188 of the carrier drive means 184 through line 230. Though not shown in FIG. 3, the control circuit 222 further comprises trigger means responsive to weft-shooting cycles of the loom and electrically connected to the first and second control pulse generators 226 and 226', respectively, so that each of the control pulse generators is enabled to produce its output pulse Qa or Qb during the weaving cycle which is immediately subsequent to a weaving cycle in which the control pulse generator 226 or 226' is supplied with an input signal Sa or Sb, respectively, similarly to the control pulse generator 98 provided in the embodiment of FIG. 1. For this purpose, each of the first and second control pulse generators 226 and 226' has incorporated therein suitable memory means of the nature described with reference to FIG. 1.

In the absence of the signals Sa and Tb at the input terminals of the first control pulse generator 226 and the improper-pick discriminating circuit 224 during operation of the loom, the solenoid units 218 and 218' of both of the first and second yarn clamp assemblies 208 and 208', respectively, are kept de-energized and thus maintain their respective movable clamp members 216 and 216' held in contact with the respectively associated stationary clamp members 214 and 214' as shown. Under these conditions, the first and second index yarns 70 and 70' respectively extending between the first and second rotatable drums 172 and 172' of the index-yarn storage means and the first and second index-yarn shooting fluid-jet nozzles 178 and 178' on the nozzle carrier 176 are held retained to the first and second yarn clamp assemblies 208 and 208', respectively. In the absence of the signal Tb at the input terminal of the improper-pick discriminating circuit 224, furthermore, the solenoid coil of the lever actuating unit 188 is also kept deenergized and has its plunger 204 held in the fully retracted axial position holding the bell-crank lever 186 in the previously mentioned first angular position thereof having the nozzle carrier 176 in its first or upper position as illustrated. When the nozzle carrier 176 is thus held in the first or upper position thereof, the first or lower index-yarn shooting fluid-jet nozzle 178 is maintained substantially in alignment with the warp line within the weft-filling shed 42 of the warp yarns 40 in the weaving stage of the loom. The fluid-discharge fitting 182 of the fluid-feed pipe 180 is therefore held incommunication with the first index-yarn shooting fluid-jet nozzle 178 on the nozzle carrier 176 but the first index yarn 70 having its yarn end admitted into the nozzle 178 is not shot out of the nozzle because the yarn is held retained to the first yarn clamp assembly 208 as above mentioned. While the fabric marking apparatus is maintained under these conditions, only the picks of the weft yarn are shot into the weft-filling shed 42 of the warp yarns 40 during consecutive weaving cycles of the loom.

When the fabric 46 woven in and stepwise conveyed away from the weaving stage of the loom reaches the predetermined unit length in a certain weaving cycle of the loom, a signal Sa is fed to the first control pulse generator 226 of the control circuit 222 so that the pulse generator 226 delivers an output pulse Qa to the solenoid unit 218 of the first yarn clamp assembly 208 through the first amplifier 228 at an incipient stage of the weft shooting cycle immediately subsequent to the above mentioned weaving cycle in which the signal Sa was fed to the pulse generator 226. With the solenoid unit 218 of the first yarn clamp assembly 208 energized, the core plunger 220 of the yarn clamp assembly 208 is caused to axially retract and moves the movable clamp member 216 out of contact with the stationary clamp member 214, thereby releasing the first index yarn 70 from the retaining engagement by the clamp assembly 208. Simultaneously when the first yarn clamp assembly 208 is thus opened up, fluid under pressure is supplied to the first index-yarn shooting fluid-jet nozzle 178 on the nozzle carrier 176 and forces the first index yarn 70 forwardly, urging the first rotatable drum 172 to turn about the axis of rotation thereof. The first index yarn 70 on the rotatable drum 172 is partially unwound therefrom and is drawn away from the drum toward the nozzle carrier 176 through the yarn-guide eye element 210, the open space between the clamp members 214 and 216 of the first yarn clamp assembly 208 and the yarn-guide element 212 by the force of the fluid being ejected from the nozzle 178. The index yarn 70 is entrained on the jet stream of the fluid from the nozzle 178 and is shot into the weft-filling shed 42 of the warp yarns 40 together with the pick of the weft yarn which is also inserted into the shed 42 from the weft shooting fluid-jet nozzle 34. The index yarn 70 is in these manners inserted into the woven fabric 44 to a length which is dictated by the period of time for which the first yarn clamp assembly 208 is kept open to allow the index yarn 70 to pass therethrough. The length of the pick of the index yarn 70 inserted into the woven fabric 44 is thus dictated by the duration or pulsewidth of the output pulse Qa delivered from the first control pulse generator 226. Upon termination of the pulse Qa, the solenoid unit 218 of the first yarn clamp assembly 208 is de-energized and brings the movable clamp member 216 of the assembly 208 into contact with the stationary clamp member 214 of the assembly with the result that the index yarn 70 which has been allowed to pass through the yarn clamp assembly 208 is for a second time retained to the clamp assembly 208 and is prohibited to travel through the yarn clamp assembly 208. The pick of the index yarn 70 inserted into the woven fabric 44 is cut off from the remainder of the index yarn in a suitable manner so that the woven fabric 44 has interwoven therein a cut segment of the first index yarn 70 as an indicium of the end of the predetermined unit length of the fabric. The first control pulse generator 226 is supplied with signals Sa at intervals at each of which the woven fabric 44 reaches the predetermined unit length so that the resultant fabric has a plurality of cut segments of the first index yarn 70 at intervals each corresponding to such a unit length.

In the event a pick of the weft yarn is inserted improperly into the weft-filling shed 42 of the warp yarns 40 during any of the weaving cycles of the loom, the improper-pick discriminating circuit 224 is supplied with a signal Tb and delivers an output signal Sb to the second control pulse generator 226'. At an incipient stage of the weft inserting cycle immediately subsequent to the particular weaving cycle in which the signal Sb was fed to the second control pulse generator 226', the pulse generator 226' delivers an output pulse Qb to the second amplifier 228' so that an amplified version of the pulse Qb is fed to the solenoid unit 218' of the second yarn clamp assembly 208' and further through the line 230 to the solenoid coil of the lever actuating unit 188. The pulse Qb fed through the amplifier 228' to the solenoid unit 218' of the second yarn clamp assembly 208' renders the clamp assembly 208' into a condition releasing the second index yarn 70' from the retaining engagement by the stationary and movable clamp members 214' and 216' of the assembly 208'. On the other hand, the amplified pulse Qb fed through the line 230 to the solenoid coil of the lever actuating unit 188 causes the plunger 204 of the unit 188 to protrude forwardly out of the fully retracted axial position thereof against the force of the biasing means incorporated in the unit 188 and drives the bell-crank lever 186 to turn clockwise of FIG. 3 about the center axis of the shaft 190, moving the nozzle carrier 176 downwardly into the second or lower position of the carrier and thereby bringing the second index-yarn shooting fluid-jet nozzle 178' into alignment with the warp line within the weft-filling shed 42 of the warp yarns 40. When the second index-yarn shooting fluid-jet nozzle 178' is thus brought into alignment with the warp line, communication is provided between the particular fluid-jet nozzle 178' and the fluid-discharge fitting 182 of the fluid-feed pipe 180 so that fluid under pressure passed over to the fluid-discharge fitting 182 is allowed to spurt out of the nozzle 178' into the weft-filling shed 42 of the warp yarns 40. With the second yarn clamp assembly 208' brought into the condition allowing the index yarn 70' to pass therethrough, the second index yarn 70' leading from the second rotatable drum 172' of the index-yarn storage means is drawn off from the rotatable drum 172' and forwardly travel away from the drum toward the nozzle carrier 176 by way of the yarn-guide eye element 210', the open area between the clamp members 214' and 216' of the second yarn clamp assembly 208' and the yarn-guide eye element 212' by the force of the fluid being ejected from the second index-yarn shooting fluid-jet nozzle 178' on the nozzle carrier 176. The second index yarn 70' is thus shot into the weft-filling shed 42 of the warp yarns 40 together with pick of the weft yarn which is also inserted into the weft-filling shed 42. When pulse Qb from the second control pulse generator 226' lapses, the solenoid unit 218' of the second yarn clamp assembly 208' and the solenoid coil of the lever actuating unit 188 are denergized so that the movable clamp member 216' of the clamp assembly 208' is moved back into contact with the stationary clamp member 214' and at the same time the plunger 204 of the lever actuating unit 188 is moved back into the fully retracted axial position thereof. It therefore follows that the second index yarn 70' is for second time retained to the second yarn clamp assembly 208' and the bell-crank lever 186 is turned back into the first angular position thereof about the center axis of the shaft 190 and raises the nozzle carrier 176 back into the first or upper position thereof having the first index-yarn shooting fluid-jet nozzle 178 aligned with the warp line within the weft-filling shed 42 of the warp yarns 40. The pick of the second index yarn 70' inserted into the weft-filling shed 42 is cut off from the remainder of the yarn 70' so that the woven fabric 44 is interwoven with a cut segment of the second index yarn 70' as an indicium of the occurrence of an improperly inserted pick of the weft yarn. The cut segment of the second index yarn 70' thus woven into the fabric 44 being different in color from the cur segment of the first index yarn 70, the natures of the discrete events indicated by these inserts of the index yarns 70 and 70' in the woven fabric 44 can be readily distinguished from each other by the colors of the inserts although such inserts may have substantially equal lengths.

Figure 4:
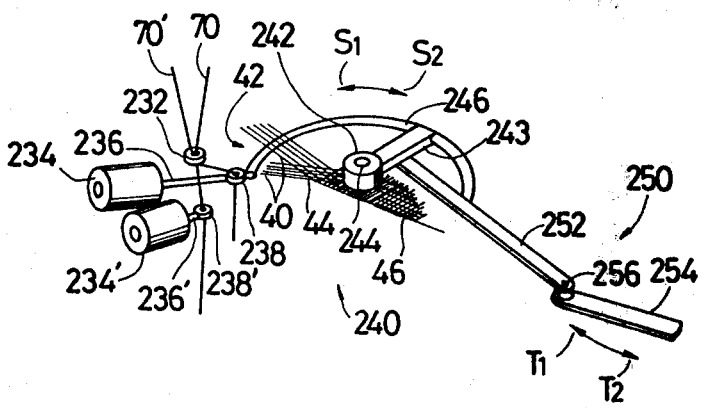
FIG. 4 is a perspective view showing a preferred example of index-yarn inserting means which form part of another embodiment of a fabric marking apparatus according to the present invention.

While the index-yarn inserting means of each of the embodiments of the present invention as hereinbefore described with reference to FIGS. 1 to 3 has been assumed to be of the fluid-jet type using a jet stream of fluid for shooting a pick of an index yarn into the weft-filling shed of warp yarns, the index-yarn inserting means of this type is merely by way of example and may be replaced with any other type of index-yarn inserting means which may be similar in construction to any known weft inserting means using, for example, a shuttle or shuttles. FIG. 4 shows an example of index-yarn inserting means using a mechanical index-yarn pull-in assembly.

Referring to FIG. 4, such index-yarn inserting means is assumed, by way of example, to be incorporated into a fabric marking apparatus to use two continuous lengths of first and second index yarns 70 and 70' which are different in color from each other as in the embodiment of FIG. 3. Though not shown, the first and second index yarns 70 and 70' are supplied from suitable index-yarn storage means which may include rotatable drums respectively allocated to the index yarns 70 and 70' as in the index-yarn storage means of the embodiment of FIG. 3 and have respective yarn end portions downwardly passed through a common yarn-guide eye element 232 which is located in the vicinity of one lateral end of the weft-filling shed 42 of the warp yarns 40 as shown and which forms part of the fabric marking apparatus incorporating the index-yarn inserting means to be described hereinafter.

The index-yarn inserting means illustrated in FIG. 4 comprises solenoid-operated, first and second yarn presenting units 234 and 234' which are positioned in the vicinity of the above mentioned yarn-guide eye element 232 and have plungers 236 and 236', respectively, which axially extend toward the above mentioned lateral end of the weft-filling shed 42 of the warp yarns 40 in the weaving loom. Each of the plungers 236 and 236' of the yarn pressing units 234 and 234' is urged to stay in a fully retracted axial position as in the case with the plunger 236' of the second yarn presenting unit 234' shown by suitable biasing means (not shown) which is incorporated into each yarn presenting unit, each plunger being axially movable a predetermined distance from the fully retracted axial position thereof against the force of such biasing means. The plungers 236 and 236' of the yarn presenting units 234 and 234' have mounted at their respective leading ends yarn-pass elements 238 and 238', respectively, each of which is formed with an aperture adapted to pass the index yarn therethrough. The first and second index yarns 70 and 70' which are downwardly passed through the yarn-guide eye element 232 are further passed through these yarn-pass elements 238 and 238', respectively, and have their leading end portions dangling below the yarn-pass elements as shown. The first and second yarn-presenting units 234 and 234' are positioned and arranged in such a manner that the yarn-pass elements 238 and 238' at the leading ends of the plungers 236 and 236' of the units are located below the yarn-guide eye element 232 respectively when the plungers 236 and 236' are in their respective fully retracted axial positions thereof and that the yarn-pass elements 238 and 238' are located in proximity to the above mentioned lateral end of the weft-filling shed 42 of the warp yarns 40 and preferably aligned with the warp line within the weft-filling shed 42 respectively when the plungers 236 and 236' of the units are moved the predetermined distance from the fully retracted axial positions of the plungers. Though not shown in the drawings, each of the yarn-presenting units 234 and 234' has further incorporated therein a solenoid coil and is constructed in such a manner that the plunger 236 or 236' of the unit is caused to protrude out of the fully retracted axial position of the plunger against the biasing means in the unit when the solenoid coil is energized from a power source. The respective solenoid coils of the yarn-presenting units 234 and 234' are connected to the power source across a suitable electric control circuit (not shown) which may be constructed and arranged basically similarly to the control circuit 222 of the embodiment of FIG. 3. In the control circuit for the yarn-presenting units 234 and 234', however, the control pulse generators similar to their counterparts in the control circuit of the embodiment of FIG. 3 need not be provided with trigger means responsive to the weft inserting cycles of the loom and memory means of the nature previously described in connection with the embodiment of FIG. 1. When the solenoid coil of each of the yarn-presenting units 234 and 234' remains de-energized, the plunger 236 or 236' of the unit is held in the fully retracted axial position by the force of the biasing means of the unit.

The index-yarn inserting means shown in FIG. 4 further comprises an index-yarn pull-in assembly 240 which consists of a center hub 242 rotatable on a stationary vertical shaft 244 and a generally arcuate yarn-picking member 246 which is positioned substantially in coaxial relationship to the center hub 242 and the shaft 244 and which is securely connected to the center hub 242 by means of a radial connecting member or limb 248. The stationary vertical shaft 244 supporting the center hub 242 is securely connected to the frame structure (not shown) of the loom and is positioned with respect to the weaving stage of the loom in such a manner that the arcuate yarn-picking member 246 is rotatable about the center axis of the shaft 244 throughout the weft-filling shed 42 of the warp yarns 40 and has a first angular position having one or yarn-picking end of the member 246 located sidewise slightly outwardly of the weft-filling shed 42 through the above mentioned lateral end of the shed 42 and in proximity to the yarn-pass element 238 or 238' of the yarn-presenting unit 234 or 234' in a condition having its plunger 236 or 236' moved the above mentioned predetermined distance from the fully retracted axial position of the plunger as is the case with the plunger 236 of the first yarn presenting unit 234 shown in FIG. 4 and a second angular position having the yarn-picking end of the member 246 located sidewise outwardly of the opposite lateral end of the weft-filling shed 42 or of the shed of the weft-retaining yarns (shown at 52 in FIG. 1). The above mentioned first and second angular positions of the yarn-picking member 246 are herein assumed to be the limit rotational positions of the member when the yarn-picking member 246 is rotated counter-clockwise and clockwise in FIG. 4, viz., in the opposite directions indicated by arrowheads $S_1$ and $S_2$, respectively, about the center axis of the shaft 244. The yarn-picking member 246 is preferably so shaped and arranged as to slightly slant downwardly toward its yarn-picking end so that the warp yarns 40 forming the weft-filling shed 42 as well as the reed (not shown) to beat the inserted picks of the weft yarn onto the fell 46 of the woven fabric 44 are not interferred with by the yarn-picking member 246 and any other part of the index-yarn pull-in assembly 240 when the yarn-picking member 246 is driven to turn in the directions of the arrows $S_1$ and $S_2$. Furthermore, the yarn-picking member 246 has fitted to the yarn-picking end thereof a suitable yarn-gripping element (not shown) so that the index yarn 70 or 70' having its yarn end portion passed through the yarn-pass element 238 or 238' on the plunger 236 or 236' of the yarn-presenting unit 234 or 234', respectively, can be hitched to the yarn-gripping element when the yarn-picking member 246 is turned in the direction of the arrowhead $S_1$ into the above mentioned first angular position thereof and meets the yarn-pass element 238 or 238' on the plunger 236 or 236' which is moved the previously mentioned predetermined distance from the fully retracted axial position thereof. As an alternative, the yarn-picking member 246 may be at least in part constituted by a hollow tube which is open at the yarn-picking end of the member 246 and which is communicable with a suitable source of suction so that the index-yarn 70 or 70' passed through the yarn-pass element 238 or 238' on the plunger 236 or 236', respectively, which is moved from the fully retracted axial position thereof as above described can be retained to the open end of the yarn-picking member 246 by the force of the suction developed in the member 246. The above described yarn-gripping element or source of suction is arranged so that the index yarn which has been hitched or otherwise retained to the yarn-picking member 246 is released therefrom upon termination of the beating operation to be performed by the reed (not shown) subsequently to the weft inserting operation during a weaving cycle in which the index yarn 70 or 70' is inserted into the weft-filling shed 42 of the warp yarns 40.

The index-yarn inserting means illustrated in FIG. 4 further comprises a drive mechanism 250 which is adapted to drive the yarn-picking member 246 of the above described index-yarn pull-in assembly 240 for angular reciprocating motion first in the direction of the arrowhead $S_1$ from the second angular position to the first angular position of the member 246 and thereafter in the direction of the arrowhead $S_2$ from the first angular position back to the second angular position of the member during each weft inserting cycle of the loom. The drive mechanism 250 is shown comprising an elongated link member 252 which is pivotally connected at one end to the radial connecting member or limb 248 of the index-yarn pull-in assembly 240 by a pin 252 and a reciprocating drive member 254 which is pivotally connected at one end to the other end portion of the link member 252 by means of a pin 256. The drive member 252 is longitudinally movable back and forth as indicated by arrowheads $T_1$ and $T_2$ so that the yarn-picking member 246 of the index-yarn pull-in assembly 240 is driven to turn in the directions of the arrowheads $S_1$ and $S_2$ about the center axis of the stationary vertical shaft 244 when the drive member 254 is longitudinally moved in the directions of the arrowheads $T_1$ and $T_2$, respectively. The drive member 254 is responsive to the weft inserting cycles of the loom and makes a reciprocating motion first in the direction of the arrowhead $T_1$ and thereafter in the direction of the arrowhead $T_2$ during each weft inserting cycle of the loom. The weft inserting means of the loom provided with the fabric marking apparatus incorporating the index-yarn shooting means of the above described nature may be of any of the known types such as the previously described fluid-jet type, though not shown in the drawings.

Throughout the operation of the loom, the arcuate yarn-picking member 246 of the index-yarn pull-in assembly 240 of the index-yarn inserting means thus constructed and arranged is driven to make the angular reciprocating motions about the center axis of the shaft 244 in response to the longitudinal reciprocating motion of the drive member 252. If the solenoid coils of both of the first and second yarn-presenting units 234 and 234' remain deenergized and accordingly the respective plungers 236 and 236' of the units are held in the fully retracted axial positions thereof by the forces of the biasing means in the units 234 and 234' when the yarn-picking member 246 is driven to turn into the first angular position about the center axis of the shaft 244, the respective yarn-pass elements 238 and 238' on these plungers 236 and 236' are located at spacings from the leading end of the yarn-picking member 246 reaching the first angular position thereof. The index yarns 70 and 70' passed through the yarn-pass elements 238 and 238' on the plungers 236 and 236' in the fully retracted axial positions thereof are therefore not hitched to the yarn-picking member 246, which accordingly is moved back to the second angular position thereof ineffaciously.

When the woven fabric 46 being produced in and conveyed away from the weaving stage of the loom reaches a predetermined unit length in a certain weaving cycle of the loom or if a pick of the weft yarn has failed to be properly shot into the weft-filling shed 42 of the warp yarns 40 during any weaving cycle of the loom, the solenoid coil of one of the first and second yarn-presenting units 238 and 238' is energized with a pulse having a predetermined duration or pulsewidth and causes the plunger 236 or 236' of the unit to protrude from the fully retracted axial position thereof into the axial position having the yarn-pass element 238 or 238' located in proximity to the yarn inserting end of the weft-filling shed 42 of the warp yarns 40 against the force of the biasing means incorporated in the unit 234 or 234', as is the case with the first yarn-presenting unit 238 illustrated in FIG. 4. When the drive member 254 of the drive mechanism 250 is then longitudinally moved in the direction of the arrowhead $T_1$ during the weft-shooting cycle which is subsequent to the weaving cycle of the loom during which the solenoid coil of the first yarn-presenting unit 238 was energized, the yarn-picking member 246 operatively connected to the drive member 254 is driven to turn in the direction of the arrowhead $S_1$ from the second angular position toward the first angular position thereof about the center axis of the shaft 244. When the yarn-picking member 246 reaches the first angular position, the yarn-picking member has its leading end located in proximity to the yarn-pass element 238 on the plunger 236 of the first yarn-presenting unit 234 having the plunger 236 in the fully protruded axial position with the result that the end portion of the index yarn 70 which is passed through the particular yarn-pass element 238 is hitched to the leading end of the yarn-picking member 246 slightly outwardly of the yarn-inserting end of the weft-filling shed 42 of the warp yarns 40. When the drive member 254 is thereafter moved backwardly in the direction of the arrowhead $T_2$, the yarn-picking member 246 is driven to turn backwardly in the direction of the arrow $S_2$ from the first angular position toward the second angular position thereof, pulling the index yarn 70 away from the yarn-pass element 238 on the plunger 236 and thereby causing the index yarn 70 to travel forwardly through the weft-filling shed 42 until the yarn-picking member 246 is withdrawn out of the weft-filling shed 42 and resumes the second angular position thereof. When the yarn-picing member 246 is thus moved back into the second angular position thereof, the index yarn 70 extends throughout the width of the weft-filling shed 42 and is stretched between the leading end of the yarn-picking member 246 and the yarn-pass element 238 on the plunger 236 of the yarn-presenting unit 234 which is still kept energized. As the index yarn 70 is thus inserted into the weft-filling shed 42, the index yarn 70 is passed through the yarn-guide element 232 and the yarn-pass element 238 on the plunger 236 of the first yarn-presenting unit 234 and is drawn off from the previously mentioned index-yarn storage means. Simultaneously as the index yarn 70 is passed through the weft-filling shed 42 of the warp yarn 40 as above described, the pick of the weft yarn is also inserted into the weft-filling shed 42 by the weft inserting means (not shown) provided in the vicinity of the yarn inserting lateral end of the shed 42. When the insertion of the respective picks of the weft yarn and the first index yarn 70 into the weft-filling shed 42 is complete, the picks of the weft and index yarns extending throughout the shed 42 are beaten up by the reed (not shown) of the loom onto the fell 44 of the woven fabric 46, whereupon the index yarn 70 is forcibly disengaged from the yarn-picking member 246 and inwoven into the fabric 46 produced at the fell 44. Under these conditions, the yarn-picking member 248 is moved back into the second angular position thereof having its leading end located out of and above the opposite lateral end of the weft-filling shed 42 to the yarn inserting end of the shed by means of the drive mechanism 250. The pulse which has been applied to the solenoid coil of the first yarn-presenting unit 234 then lapses to enable the plunger 246 to withdraw into the initial fully retracted axial position thereof having the yarn-pass element 238 located at a spacing from the yarn inserting lateral end of the weft-filling shed 42. The picks of the weft and index yarns now forming part of the woven fabric 46 are thereafter cut off from the respective reminders of the yarns by suitable cutting means (not shown) provided in the loom as in the arrangement previously described with reference to FIG. 1. If a pulse is fed to the solenoid coil of the second yarn-presenting unit 234', the second index yarn 70' is in similar manners inserted into the weft-filling shed 42 of the warp yarns 40 by the aid of the yarn-picking member 248 of the index-yarn pull-in assembly 240. The first and second index yarns 70 and 70' differing in color from each other are thus inserted into the woven fabric 46 selectively depending upon the pulses which are impressed upon the first and second yarn-presenting units 234 and 234', respectively.

While a few embodiments of the fabric marking apparatus according to the present invention have hereinbefore been described and shown, it should be borne in mind that such embodiments are merely by way of illustration of the gist of the present invention and accordingly that the embodiments herein shown are subject to various modification and change if and where desired. While, for example, the present invention has been assumed to be embodied in such a manner that the natures of the discrete events occurring in a fabric being woven are distinguished from one another by the difference between the lengths or colors of the inserts inwoven into the fabric, such natures may be distinguished by the number of the inserts inwoven into a fabric in such a manner that each of the discrete events of one nature is indicated by a single insert of an index yarn and each of the discrete events of another nature is indicated by two or three inserts of either the same index yarn or any other index yarn or yarns.

What is claimed is:

1. In a weaving loom in which a woven fabric is to be produced by warp yarns forming a weft-filling shed in each weaving cycle of the loom and a pick of a weft yarn inserted into the weft-filling shed during each weaving cycle, a method of marking the woven fabric with indicia of the occurrences of discrete events of at least one predetermined nature in the fabric being woven, comprising:

(a) detecting the occurrence of each of the discrete events in the fabric being woven, and (b) inserting a pick of an index yarn into the weft-filling shed of the warp yarns in response the occurrence of each of the events detected.

2. A method as set forth in claim 1, in which the pick of the index-yarn is inserted into the weft-filling shed of the warp yarns substantially concurrently when a pick of the weft yarn is inserted into shed.

3. A method as set forth in claim 1, in which the pick of the index-yarn is inserted into the weft-filling shed of the warp yarns during the weaving cycle which is immediately subsequent to each weaving cycle in which the occurrence of each of the discrete events is detected.

4. A method as set forth in claim 3, in which the occurrence of each of the discrete events is detected upon termination of the weft inserting operation in each weaving cycle of the loom and the pick of the index yarn is inserted into the weft-filling shed of the warp yarns substantially concurrently when a pick of the weft yarn is inserted into the weft-filling shed during the weaving cycle immediately subsequent to each weaving cycle in which the occurrence of each of the discrete events is detected.

5. A method as set forth in claim 1, further comprising producing signals each indicative of the detected occurrence of each of the discrete events, the pick of the index yarn being inserted into the weft-filling shed of the warp yarns in response to each of said signals.

6. A method as set forth in claim 5, wherein each of said signals is produced during each of the weaving cycles in which the occurrences of the discrete events are detected and wherein the pick of the index yarn is inserted into the weft-filling shed of the warp yarns during the weaving cycle which is immediately subsequent to each of the weaving cycles in which said signals are produced.

7. A method as set forth in claim 1, in which the pick of the index yarn is inserted into the weft-filling shed of the warp yarns from one lateral end of the shed by a length less than the width of the weft-filling shed.

8. A method as set forth in claim 7, in which the pick of the index yarn is inserted into the weft-filling shed of the warp yarns from one lateral end of the shed by a length substantially equal to the width of the weft-filling shed.

9. A method as set forth in claim 1, further comprising measuring a predetermined length of the index yarn and having the measured length of the index yarn detained in the vicinity of the weft-filling shed of the warp yarns upon detection of the occurrence of each of the discrete events, the measured length of the index yarn being fed toward and inserted into the weft-filling shed during the weaving cycle which is immediately subsequent to each weaving cycle in which the occurrence of each discrete event is detected.

10. A method as set forth in claim 1, in which the pick of the index yarn is inserted into the weft-filling shed of the warp yarns by means of a jet stream of fluid ejected into the shed through one lateral end of the weft-filling shed.

11. A method as set forth in claim 10, in which said jet stream of fluid is ejected into the weft-filling shed during each of the weaving cycles of the loom.

12. A method as set forth in claim 10, in which said jet stream of fluid is ejected into the weft-filling shed during the weaving cycle which is immediately subsequent to each weaving cycle during which the occurrence of each of the discrete events is detected.

13. A method as set forth in claim 1, in which the pick of the index yarn is inserted into the weft-filling shed of the warp yarns by a mechanical force pulling the pick of the index yarn from one lateral end of the shed toward the other.

14. A method as set forth in claim 13, in which the pick of the index yarn is inserted into the weft-filling shed of the warp yarns throughout the width of the shed.

15. In a weaving loom in which a woven fabric is to be produced by warp yarns forming a weft-filling shed in each weaving cycle of the loom and a pick of a weft yarn inserted into the weft-filling shed during each weaving cycle, a method of marking the woven fabric with indicia of the occurrences of discrete events of predetermined natures in the fabric being woven, comprising:

(a) preparing at least one continuous length of index yarn for being fed to the loom from an index-yarn supply package,
(b) detecting the occurrence of each of the discrete events in the fabric being woven,
(c) producing signals each indicative of the detected occurrence of each of the discrete events and having a predetermined characteristic which is proper to the particular nature of the event detected,
(d) drawing the index yarn from said index-yarn supply package in response to each of said signals by a predetermined length which is proper to the characteristic of each signal, and
(e) inserting the drawn length of the index yarn into the weft-filling shed.

16. A method as set forth in claim 15, further comprising producing electrical pulses Pa, Pb respectively in response to said signals, each of the pulses responsive to those signals which commonly have each of the characteristics respectively proper to said natures having a predetermined duration which is proper to each of the natures, the index yarn being drawn from said supply package a distance which is substantially proportional to the duration of each of said pulses.

17. A method as set forth in claim 16, in which the drawing of the index yarn from said supply package and the insertion of the drawn length of the index yarn into the weft-filling shed of the warp yarns are effected during the weaving cycle which is immediately subsequent to each of the weaving cycles in which said signals are produced.

18. A method as set forth in claim 17, in which said drawing and said insertion are effected substantially concurrently while a pick of the weft yarn is being inserted into the weft-filling shed of the warp yarns.

19. A method as set forth in claim 16, in which the drawing of the index yarn from said supply package is commenced during each of the weaving cycles in which said signals are produced and the insertion of the drawn length of the index yarn into the weft-filling shed of the warp yarns is effected during the weaving cycle which is immediately subsequent to the weaving cycle in which each signal is produced.

20. A method as set forth in claim 19, further comprising detaining said drawn length of the index yarn between said supply package and the weft-filling shed of the warp yarns upon termination of each of said pulses Pa, Pb.

21. In a weaving loom in which a woven fabric is to be produced by warp yarns forming a weft-filling shed in each weaving cycle of the loom and a pick of a weft yarn inserted into the weft-filling shed during each weaving cycle, a method of marking the woven fabric with indicia of the occurrences of discrete events of predetermined natures in the fabric being woven, comprising:

(a) preparing at least two continuous lengths of index yarns for being fed to the loom from respective index-yarn supply packages,
(b) detecting the occurrence of each of the discrete events in the fabric being woven,
(c) producing signals each indicative of the detected occurrence of each of the discrete events and having a predetermined characteristic which is proper to the particular nature of the event detected,
(d) selecting one of the index yarns depending upon the particular characteristics of each of said signals,
(e) drawing the selected index yarn from the supply package of the index yarn by a predetermined length, and
(f) inserting the drawn length of the index yarn into the weft-filling shed of the warp yarns.

22. A method as set forth in claim 21, further comprising producing electrical pulses respectively in response to said signals, each of the pulses responsive to those signals which commonly have each of the characteristics respectively proper to said natures having a predetermined duration which is proper to each of the natures, the selected index yarn being drawn from the supply package of the index yarn a distance which is substantially proportional to the duration of each of said pulses.

23. A method as set forth in claim 21, in which the drawing of the selected index yarn from the supply package of the index yarn and the insertion of the drawn length of the index yarn into the weft-filling shed of the warp yarns are effected substantially concurrently while a pick of the weft yarn is being inserted into the weft-filling shed.

24. A method as set forth in claim 23, in which said drawing and said insertion are effected during the weaving cycle which is immediately subsequent to each of the weaving cycles in which said signals are produced.

25. A method as set forth in claim 21, in which said index yarns are of natures which are different from each other.

26. A method as set forth in claim 25, in which said index yarns differ in color from each other.

27. In a waving loom in which a woven fabric is to be produced by warp yarns forming a weft-filling shed in each weaving cycle of the loom and a pick of a weft yarn inserted into the weft-filling shed during each weaving cycle, a fabric marking apparatus for marking the woven fabric with indicia of the occurrences of discrete events of predetermined natures in the fabric being woven, comprising:

(a) index-yarn storage means for supplying at least one continuous length of index yarn 70,70'
(b) index-yarn retaining and inserting means operative to draw the index yarn from said storage means and inserting a pick of the index yarn into the weft-filling shed of the warp yarns when actuated, and (c) control means responsive to the occurrences of the discrete events in the fabric being woven and operative to actuate said retaining and inserting means in response the occurrence of each of the discrete events for causing the retaining and inserting means to draw the index yarn from said storage means and insert a pick of the index yarn into the weft-filling shed depending upon the individual natures of the discrete events.

28. A fabric marking apparatus as set forth in claim 27, in which said control means is operative to produce signals which are respectively indicative of the occurrences of the discrete events in the fabric being woven and which have predetermined characteristics which are respectively proper to said natures of the discrete events.

29. A fabric marking apparatus as set forth in claim 28, in which said retaining and inserting means is kept operative for periods of time which differ with said predetermined characteristics of said signals for drawing the index yarn from said storage means and inserting picks of the index yarn into the weft-filling shed in response to said signals by lengths which vary with the natures of the discrete events.

30. A fabric marking apparatus as set forth in claim 29, in which said retaining and inserting means comprises index-yarn inserting means positioned in the vicinity of one lateral end of the weft-filling shed of the warp yarns and capable of passing therethrough a pick of the index yarn to be inserted into the weft-filling shed, and first and second yarn clamp assemblies positioned at a spacing from each other intermediate between said index-yarn storage means and said index-yarn inserting means and each having a first condition capable of having the index yarn retained thereto and a second condition allowing the index yarn to travel therethrough away from the index-yarn storage means toward the index-yarn inserting means, the first yarn clamp assembly being located closer to said storage means and responsive to said signals for being held in the first condition thereof in the absence of said signals and in the second condition thereof in response to each of said signals for predetermined periods of time which differ with said predetermined characteristics of the signals, the second yarn clamp assembly being located closer to said index-yarn inserting means and responsive to the cycles in which picks of the weft yarn are to be inserted into the weft-filling shed of the warp yarns for being rendered into the second condition thereof in the individual weft inserting cycles of the loom.

31. A fabric marking apparatus as set forth in claim 30, further comprising selective index-yarn length-measuring and draw-off means responsive to said signals for forcing the index yarn to travel through said first yarn clamp assembly in the second condition thereof toward second yarn clamp assembly by predetermined lengths which differ with said predetermined characteristics of said signals.

32. A fabric marking apparatus as set forth in claim 31, in which said selective index-yarn length-measuring and draw-off means comprises at least two levers rotatable about a common axis substantially in parallel with a substantially straight path of the index yarn between said first and second yarn clamp assemblies, each of the levers having an end portion movable in an arc through said path and formed with an aperture to pass the index yarn therethrough, and lever actuating units respectively connected to said levers and each operative to drive the associated lever to turn about said axis between a first angular position having the end portion of the lever located in said path and a second angular position angularly spaced apart a predetermined length from the first angular position about said axis, the predetermined angles of rotation of the levers between the respective first and second angular positions of the levers being different from one another.

33. A fabric marking apparatus as set forth in claim 28, in which said index-yarn storage means comprises at least two index yarn feeding units for feeding at least two continuous lengths of index yarns therefrom and in which said retaining and inserting means comprises a carrier positioned and movable in the vicinity of one lateral end of the weft-filling shed of the warp yarn, at least two index-yarn shooting members securely mounted on said carrier and directed toward the weft-filling shed, the index-yarn shooting members being capable of having said index yarns from said index-yarn feeding units passed therethrough toward the weft-filling shed, said carrier being movable between different positions each having each of said index-yarn shooting members substantially aligned with the weft-filling shed of the warp yarns, and a drive mechanism operatively connected to said carrier for moving the carrier between said positions thereof.

34. A fabric marking apparatus as set forth in claim 33, in which said retaining and inserting means further comprises at least two yarn clamp assemblies positioned between said index-yarn storage means and said carrier and each having a first condition having one of said index yarns retained thereto and a second condition allowing said one of the index yarns to travel therethrough toward said carrier, each of said yarn clamp assemblies being responsive to said signals for being held in the first condition thereof in the absence of the signals and in the second condition thereof in response to each of the signals having each of said predetermined characteristics.

35. A fabric marking apparatus as set forth in claim 28, in which said retaining and inserting means comprises at least two yarn-presenting units positioned in the vicinity of one lateral end of the weft-filling shed of the warp yarns and each including a movable member which is movable toward and away from said lateral end of the weft-filling shed and which is capable of presenting a yarn at said end when moved toward the end, and a pull-in assembly including a generally arcuate yarn picking member rotatable about an axis perpendicular to but in non-intersecting relationship to the path of a pick of the weft yarn through the shed, said yarn picking member being rotatable about said axis thereof through the weft-filling shed of the warp yarns between an angular position having its leading end located in proximity to said lateral end of the shed and an angular position having the leading end located sidewise out of the opposite lateral end of the shed.

* * * * *